US010299600B2

(12) United States Patent
Cribbs

(10) Patent No.: US 10,299,600 B2
(45) Date of Patent: May 28, 2019

(54) PORTABLE MEMORY FOAM SEAT CUSHION

(71) Applicant: Brittany Cribbs, Philadelphia, PA (US)

(72) Inventor: Brittany Cribbs, Philadelphia, PA (US)

( * ) Notice: Subject to any disclaimer, the term of this patent is extended or adjusted under 35 U.S.C. 154(b) by 0 days.

(21) Appl. No.: 15/821,746

(22) Filed: Nov. 22, 2017

(65) Prior Publication Data

US 2018/0140100 A1 May 24, 2018

Related U.S. Application Data

(60) Provisional application No. 62/425,151, filed on Nov. 22, 2016.

(51) Int. Cl.

| | |
|---|---|
| ***A47C 31/11*** | (2006.01) |
| ***A47C 7/02*** | (2006.01) |
| ***A47C 7/18*** | (2006.01) |
| ***A47C 7/22*** | (2006.01) |
| ***A47C 7/14*** | (2006.01) |
| ***A47C 7/40*** | (2006.01) |
| ***A47C 31/10*** | (2006.01) |
| ***A47C 7/42*** | (2006.01) |

(52) U.S. Cl.

CPC ..... *A47C 7/021* (2013.01); *A47C 7/14* (2013.01); *A47C 7/18* (2013.01); *A47C 7/22* (2013.01); *A47C 7/407* (2013.01); *A47C 7/425* (2013.01); *A47C 31/10* (2013.01)

(58) Field of Classification Search

CPC .... A47C 7/14; A47C 7/18; A47C 7/22; A47C 7/407; A47C 7/425; A47C 31/10

USPC ..... 297/228.1–230.14

See application file for complete search history.

(56) References Cited

U.S. PATENT DOCUMENTS

| | | | | | |
|---|---|---|---|---|---|
| 1,659,405 | A * | 2/1928 | Love | A47C 7/425 | 297/229 |
| 1,959,920 | A * | 5/1934 | Kaiser | A47C 21/022 | 297/229 |
| 2,696,872 | A * | 12/1954 | Kurland | A47G 9/0246 | 297/229 |
| 3,022,808 | A * | 2/1962 | Silver | B60J 11/00 | 297/228.12 X |
| 3,278,226 | A * | 10/1966 | Magnusson | A47C 27/15 | 297/228.12 X |
| 3,504,941 | A * | 4/1970 | Gerard | A47C 31/11 | 297/228.1 X |
| 3,517,963 | A * | 6/1970 | Woods | A47C 7/18 | 297/228 |
| 3,813,148 | A * | 5/1974 | Kraus | A47C 7/425 | 297/230.11 |
| 4,161,337 | A * | 7/1979 | Ross | A47C 7/405 | 297/230.12 |
| 4,190,918 | A * | 3/1980 | Harvell | A47C 4/52 | 297/228.1 X |
| 4,383,712 | A * | 5/1983 | Kaganas | A47C 31/11 | 297/228.12 |
| 4,518,198 | A * | 5/1985 | Daniels | A45C 9/00 | 297/229 X |

(Continued)

*Primary Examiner* — Rodney B White

(74) *Attorney, Agent, or Firm* — Paul & Paul

(57) ABSTRACT

A portable memory foam seat cushion has a seat portion and a back portion and can be rolled up into a rolled-up configuration for ease of portability. Straps secure the seat cushion in the rolled-up configuration. The seat cushion also has handle straps and a shoulder strap for carrying the seat cushion while it is in the rolled-up configuration.

17 Claims, 25 Drawing Sheets

(56) References Cited

U.S. PATENT DOCUMENTS 4,597,605 A * 7/1986 Gilbert ..... A47C 7/425 297/228.1 X
4,725,094 A * 2/1988 Greer ..... A47C 31/02 297/229 X
4,828,320 A * 5/1989 Saiger ..... A47C 7/24 297/229
4,844,540 A * 7/1989 Pegram ..... A47C 1/14 297/229
4,925,241 A * 5/1990 Geraci ..... A47C 7/021 297/229 X
4,998,311 A * 3/1991 Ernst ..... A47C 7/021 297/228.1
5,088,747 A * 2/1992 Morrison ..... A61G 5/1043 297/230.1 X
5,275,463 A * 1/1994 Rocha ..... A47C 31/11 297/228.12 X
5,294,166 A * 3/1994 Shapland ..... B60N 2/6009 297/229 X
5,297,848 A * 3/1994 Grinnell ..... A47C 7/029 297/230.14 X
5,388,293 A * 2/1995 Kistner ..... A47G 9/0253 297/229
5,584,422 A * 12/1996 Bond-Madsen ..... A45F 4/02 297/229 X
5,588,445 A * 12/1996 Obaidi ..... A47D 13/04 297/230.1 X
5,613,730 A * 3/1997 Buie ..... B60N 2/5614 297/228.12 X
5,639,145 A * 6/1997 Alderman ..... A47C 7/021 297/229 X
5,868,463 A * 2/1999 MacKenzie ..... A47C 7/021 297/228.12
6,131,995 A * 10/2000 Smith ..... B60N 2/6063 297/229 X
6,135,635 A * 10/2000 Miller ..... A45F 4/02 297/229 X
6,155,647 A * 12/2000 Albecker, III ..... A47C 1/146 297/228.12
6,485,100 B1 * 11/2002 Hitt ..... A47C 7/18 297/228.13 X
6,588,840 B1 * 7/2003 Lombardo ..... A47C 1/16 297/228.12 X
6,848,746 B2 * 2/2005 Gentry ..... A47C 7/748 297/228.1 X
7,097,244 B2 * 8/2006 Holmgren ..... B60N 2/2809 297/228.12 X
7,125,075 B2 * 10/2006 Thompson ..... A01M 31/02 297/230.1
7,231,677 B1 * 6/2007 Reeves ..... A47G 9/0246 297/229
7,517,013 B1 * 4/2009 Lowe ..... A47C 7/742 297/228.1 X
7,614,691 B1 * 11/2009 Schmitz ..... A47C 7/021 297/229 X
7,774,880 B1 * 8/2010 Botts ..... A47C 7/021 297/228.1
7,931,335 B1 * 4/2011 Siklosi ..... B60N 2/6027 297/228.1 X
8,733,836 B2 * 5/2014 Gross ..... A47C 7/22 297/228.12
8,973,993 B2 * 3/2015 Hall ..... B60N 2/7005 297/228.13 X
2001/0035672 A1 * 11/2001 Graff ..... A47C 1/14 297/229
2002/0063455 A1 * 5/2002 Self ..... A47C 1/14 297/229
2004/0108757 A1 * 6/2004 Jackson ..... A47C 1/143 297/229
2004/0195878 A1 * 10/2004 Kassai ..... B62B 7/123 297/229 X
2005/0173953 A1 * 8/2005 Riley ..... A47C 31/11 297/228.1
2010/0001565 A1 * 1/2010 Gray ..... A47C 7/62 297/229
2011/0049951 A1 * 3/2011 Bettencourt ..... A47C 31/11 297/229
2011/0163581 A1 * 7/2011 Leeds ..... A47C 7/021 297/229
2011/0254333 A1 * 10/2011 Taichman ..... A47C 7/425 297/230.1
2013/0187415 A1 * 7/2013 Shelley ..... A47C 31/11 297/228.11 X
2014/0191545 A1 * 7/2014 Satmary ..... A47C 31/11 297/228.1
2014/0223666 A1 * 8/2014 Pavlin ..... A47C 27/15 297/229 X
2015/0123439 A1 * 5/2015 Jordan ..... A47C 31/113 297/228.1
2015/0230617 A1 * 8/2015 Yawe ..... A47C 7/66 297/228.12
2016/0066694 A1 * 3/2016 Blakeney ..... A47C 7/021 297/228.13

* cited by examiner

PORTABLE MEMORY FOAM SEAT CUSHION

CROSS-REFERENCE TO RELATED APPLICATIONS

This application claims the benefit of U.S. Provisional Application No. 62/425,151, filed on Nov. 22, 2016, which is incorporated herein by reference in its entirety.

BACKGROUND OF THE INVENTION

Airline travel, particularly over extended distances, can be very taxing on the human body. Passengers may have to stay seated on board an aircraft for fifteen to eighteen hours on some long distance international flights. Staying seated for hours at a time has certain health risks. The most serious is the development of blood clots or thrombosis, which can form in the veins or arteries of the lower extremities and result from being seated for long periods. Such conditions are extremely painful and if not treated immediately can lead to tissue damage and necrosis (tissue death) in the legs or other parts of the body. Parts of the blood clot may break off and travel to other parts of the body and possibly leading to pulmonary embolism or stroke, which are life threatening conditions. Such conditions are thought to be associated with excessive pressure on the back of the thighs and buttocks for extended periods of time. Similar problems are faced by bus passengers.

Also, airline or bus passenger seats or seats in other areas such as waiting rooms may not be very comfortable, with the result that passengers or persons may become impatient, irritable, or frustrated and not be able to stay seated for the required duration of time. Accordingly, the level of comfort provided by many types of seats commonly used by the public has not been entirely satisfactory.

SUMMARY OF THE INVENTION

The present invention is directed to a portable memory foam seat cushion having a seat portion and a back portion that can be rolled up into a roll. Straps secure the seat cushion in the rolled-up configuration. The seat cushion also has handle straps and a shoulder strap for carrying the seat cushion in the rolled-up configuration.

Accordingly, it is an aspect of the present invention to provide a portable seat cushion including a seat and a back that can be rolled up into a rolled-up configuration for ease of portability.

It is another aspect of the present invention to provide a portable seat cushion comprising:

a seat having a left side, a right side, a front side, a rear side, a top surface, and a bottom surface, the seat including a seat cover and a seat cushion insert, the seat cover forming a pocket for receiving and enclosing the seat cushion insert; and a back having a left side, a right side, a top side, a bottom side, a front surface, and a rear surface, the back including a back cover and a back cushion insert, the back cover forming a pocket for receiving and enclosing the back cushion insert, wherein the seat is attached to the back by the rear side of the seat being attached to the bottom side of the back, wherein the seat cushion insert has a left side, a right side, a front side, a rear side, a top surface, and a bottom surface, wherein the back cushion insert has a left side, a right side, a top side, a bottom side, a front surface, and a rear surface, and wherein the seat cushion can be rolled up into a rolled-up configuration for ease of portability.

It is another aspect of the present invention to provide a portable seat cushion in accordance with any of the aspects of the present invention described herein, wherein the seat cushion insert and the back cushion insert are made of memory foam.

It is another aspect of the present invention to provide a portable seat cushion in accordance with any of the aspects of the present invention described herein, wherein the seat cushion insert and the back cushion insert are made of high density memory foam.

It is another aspect of the present invention to provide a portable seat cushion in accordance with any of the aspects of the present invention described herein, wherein the seat cover has a left side, a right side, a front side, a rear side, a top surface, and a bottom surface, wherein the back cover has a left side, a right side, a top side, a bottom side, a front surface, and a rear surface, wherein the seat is attached to the back by the seat cover being attached to the back cover, and wherein the seat cover is attached to the back cover by the rear side of the seat cover being attached to the bottom side of the back cover.

It is another aspect of the present invention to provide a portable seat cushion in accordance with any of the aspects of the present invention described herein, wherein the seat cushion insert has a tapering portion that is coextensive with the rear side of the seat cushion insert such that the tapering portion of the seat cushion insert is of a decreasing thickness in the direction of the rear side of the seat cushion insert and the seat cushion insert has an approximately wedge-shaped cross section proximate the rear side of the seat cushion insert.

It is another aspect of the present invention to provide a portable seat cushion in accordance with any of the aspects of the present invention described herein, wherein the back cushion insert has a tapering portion that is coextensive with the bottom side of the back cushion insert such that the tapering portion of the back cushion insert is of a decreasing thickness in the direction of the bottom side of the back cushion insert and the back cushion insert has an approximately wedge-shaped cross section proximate the bottom side of the back cushion insert.

It is another aspect of the present invention to provide a portable seat cushion in accordance with any of the aspects of the present invention described herein, wherein the seat cushion insert has a first rounded corner connecting the left side of the seat cushion insert to the front side of the seat cushion insert, wherein the seat cushion insert has a second rounded corner connecting the right side of the seat cushion insert to the front side of the seat cushion insert, wherein the seat cushion insert has a first beveled corner connecting the left side of the seat cushion insert to the rear side of the seat cushion insert, and wherein the seat cushion insert has a second beveled corner connecting the right side of the seat cushion insert to the rear side of the seat cushion insert.

It is another aspect of the present invention to provide a portable seat cushion in accordance with any of the aspects of the present invention described herein, wherein the back cushion insert has a first rounded corner connecting the left side of the back cushion insert to the top side of the back cushion insert, wherein the back cushion insert has a second rounded corner connecting the right side of the back cushion insert to the top side of the back cushion insert, wherein the back cushion insert has a first beveled corner connecting the left side of the back cushion insert to the bottom side of the back cushion insert, and wherein the back cushion insert has a second beveled corner connecting the right side of the back cushion insert to the bottom side of the back cushion insert.

It is another aspect of the present invention to provide a portable seat cushion in accordance with any of the aspects of the present invention described herein, wherein the back cushion insert is longer than the seat cushion insert.

It is another aspect of the present invention to provide a portable seat cushion in accordance with any of the aspects of the present invention described herein, wherein the seat cover includes a top seat panel and a bottom seat panel, each made of a woven fabric and having a perimeter, that are sewn together, at least along portions of each of the top seat panel and the bottom seat panel proximate the perimeter of each of the top seat panel and the bottom seat panel, to form the pocket for receiving the seat cushion insert, and wherein the back cover includes a front back panel and a rear back panel, each made of a woven fabric and having a perimeter, that are sewn together, at least along portions of each of the front back panel and the rear back panel proximate the perimeter of each of the front back panel and the rear back panel, to form the pocket for receiving the back cushion insert.

It is another aspect of the present invention to provide a portable seat cushion in accordance with any of the aspects of the present invention described herein, wherein the seat cover has a seam extending along the left side, the right side, and the front side of the seat cover, wherein the back cover has a seam extending along the left side, the right side, and the top side of the back cover, wherein the seam of the seat cover is contiguous with the seam of the back cover, and wherein the seam of the seat cover and the seam of the back cover are reinforced by a welt bead or welt piping extending continuously along the left side, the right side, and the front side of the seat cover, and along the left side, the right side, and the top side of the back cover.

It is another aspect of the present invention to provide a portable seat cushion in accordance with any of the aspects of the present invention described herein, wherein the seat cover has an opening for the insertion of the seat cushion insert, and the opening of the seat cover being provided with a first zipper closure for selectively opening and closing the opening of the seat cover, and wherein the back cover has an opening for the insertion of the back cushion insert, and the opening of the back cover being provided with a second zipper closure for selectively opening and closing the opening of the back cover.

It is another aspect of the present invention to provide a portable seat cushion in accordance with any of the aspects of the present invention described herein, wherein the portable seat cushion is configured, by the seat cushion insert and the back cushion insert each being sufficiently thin, to allow the portable seat cushion to be rolled up into a roll and form a rolled-up portable seat cushion with the seat being rolled up inside the back, the roll having an outside, such that the rear back panel is positioned around the outside of the roll.

It is another aspect of the present invention to provide a portable seat cushion in accordance with any of the aspects of the present invention described herein, wherein the rolled-up portable seat cushion is in a rolled-up configuration, wherein the portable seat cushion further comprises a pair of straps each having a first end and a second end, and each of the straps being long enough so that each of the straps can be placed around the rolled-up portable seat cushion and the first end and the second end of each of the straps are configured to be fastened together to hold the rolled-up portable seat cushion in the rolled-up configuration.

It is another aspect of the present invention to provide a portable seat cushion in accordance with any of the aspects of the present invention described herein, wherein each of the straps is sewn to the rear back panel over at least a portion of each of the straps, the straps being positioned on the rear back panel in parallel to each other, and wherein the straps are spaced apart from each other.

It is another aspect of the present invention to provide a portable seat cushion in accordance with any of the aspects of the present invention described herein, wherein the first end of each of the straps is provided with a fastening means selected from a hook and loop fastener portion, a buckle, a side-release buckle plug, a side-release buckle socket, a length of free strap, a strap adjuster, a ring, and a snap hook, and wherein the second end of each of the straps is provided with a fastening means selected from a hook and loop fastener portion, a buckle, a side-release buckle plug, a side-release buckle socket, a length of free strap, a strap adjuster, a ring, and a snap hook, that is complementary to the fastening means provided at the first end of a respective one of the straps.

It is another aspect of the present invention to provide a portable seat cushion in accordance with any of the aspects of the present invention described herein, wherein the length of each of the straps extending between the portion of each of the straps that is sewn to the rear back panel and at least one of the fastening means provided at the first and second ends of each of the straps is adjustable.

It is another aspect of the present invention to provide a portable seat cushion in accordance with any of the aspects of the present invention described herein, further comprising:

a first carrying handle formed by a first carrying handle strap and a second carrying handle formed by a second carrying handle strap, each of the first carrying handle strap and the second carrying handle strap having a first end and a second end, the first carrying handle and the second carrying handle each having a length, the first and second carrying handle being attached to the rear surface of the back of the portable seat cushion.

It is another aspect of the present invention to provide a portable seat cushion in accordance with any of the aspects of the present invention described herein, wherein the portable seat cushion is placed on a seat or chair, having a seat and a back, between the seat or chair and a person sitting on the seat or chair to provide greater comfort to the person, the portable seat cushion further comprising a shoulder strap having a length, the shoulder strap extending between attachment points on the left and right sides of the back of the portable seat cushion, the shoulder strap being configured to allow over-the-shoulder carry of the portable seat cushion when the portable seat cushion is in the rolled-up configuration, the shoulder strap being configured for being placed around the back of a seat or chair and cinched around the back of the seat or chair to thereby secure the portable seat cushion to the seat or chair with the seat of the portable seat cushion being positioned over the seat of the seat or chair, and the length of the shoulder strap being adjustable.

It is another aspect of the present invention to provide a portable seat cushion in accordance with any of the aspects of the present invention described herein, further comprising:

a first ring provided on the portion of the second strap that is sewn to the rear back panel;

a second ring provided on the portion of the second strap that is sewn to the rear back panel at a location spaced apart from the first ring;

a first three bar strap slide provided on the first carrying handle strap at a position along the first carrying handle strap, the first three bar strap slide having two lateral bars and a middle bar; and a second three bar strap slide provided on the second carrying handle strap at a position along the second carrying handle strap, the second three bar strap slide having two lateral bars and a middle bar, wherein the first end of the first carrying handle strap and the first end of the second carrying handle strap are attached to the portion of the first strap that is sewn to the rear back panel at locations that are spaced apart, wherein a first portion of the first carrying handle strap extends between the lateral bars and the middle bar of the first strap slide such that the first carrying handle strap passes from one side of the first strap slide to the other side, passes around the middle bar of the first strap slide, and then passes back to the one side of the first strap slide, wherein the first carrying handle strap extends further in a loop through the first ring and returns to the first strap slide and passes between the middle bar of the first strap slide and the first portion of the first carrying handle strap and is then sewn back on itself to thereby form a sleeve around the middle bar of the first strap slide and fix the first strap slide to the second end of the first carrying handle strap, wherein the length of the first carrying handle can be adjusted by adjusting the position of the first strap slide along the first carrying handle strap, wherein a first portion of the second carrying handle strap extends between the lateral bars and the middle bar of the second strap slide such that the second carrying handle strap passes from one side of the second strap slide to the other side, passes around the middle bar of the second strap slide, and then passes back to the one side of the second strap slide, wherein the second carrying handle strap extends further in a loop through the second ring and returns to the second strap slide and passes between the middle bar of the second strap slide and the first portion of the second carrying handle strap and is then sewn back on itself to thereby form a sleeve around the middle bar of the second strap slide and fix the second strap slide to the second end of the second carrying handle strap, wherein the length of the second carrying handle can be adjusted by adjusting the position of the second strap slide along the second carrying handle strap.

These and other aspects and advantages of the present invention will be further elucidated by the following Detailed Description, drawing figures, and claims.

BRIEF DESCRIPTION OF THE DRAWING FIGURES

DETAILED DESCRIPTION

Figure 1:
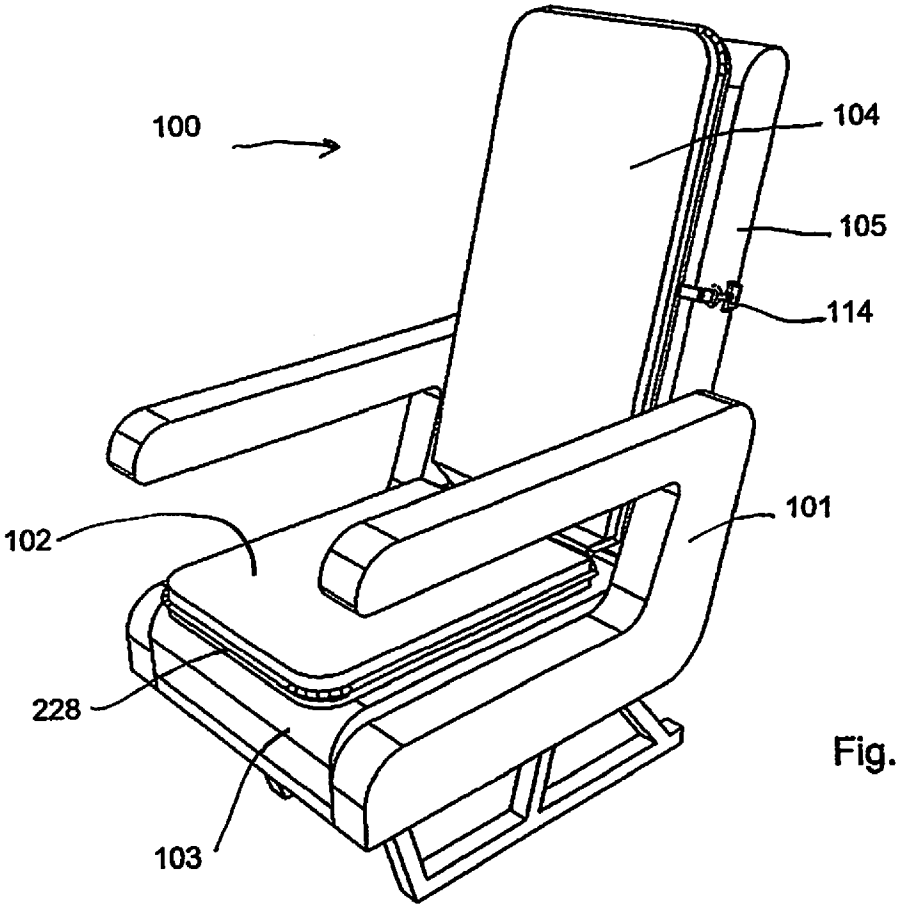
FIGS. 1-4 show environmental views of a portable seat cushion according to the present invention.
Figure 2:
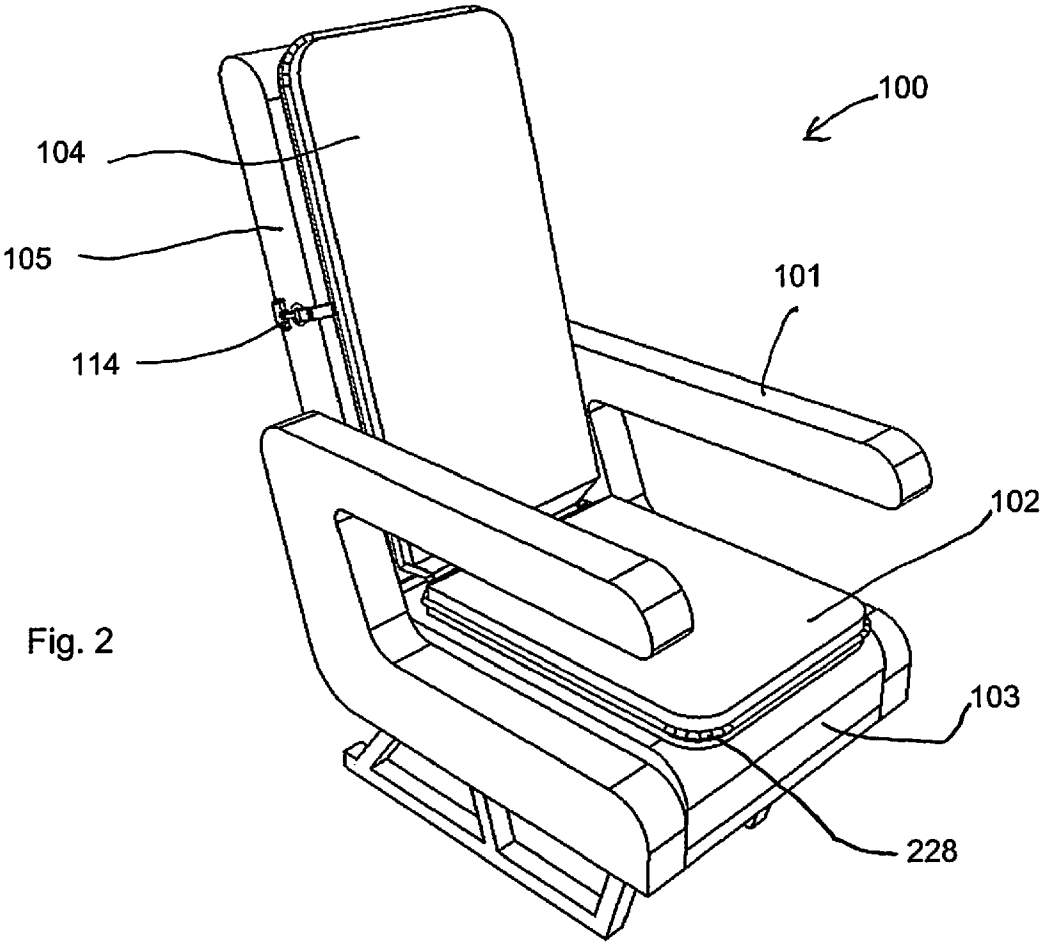
Figure 3:
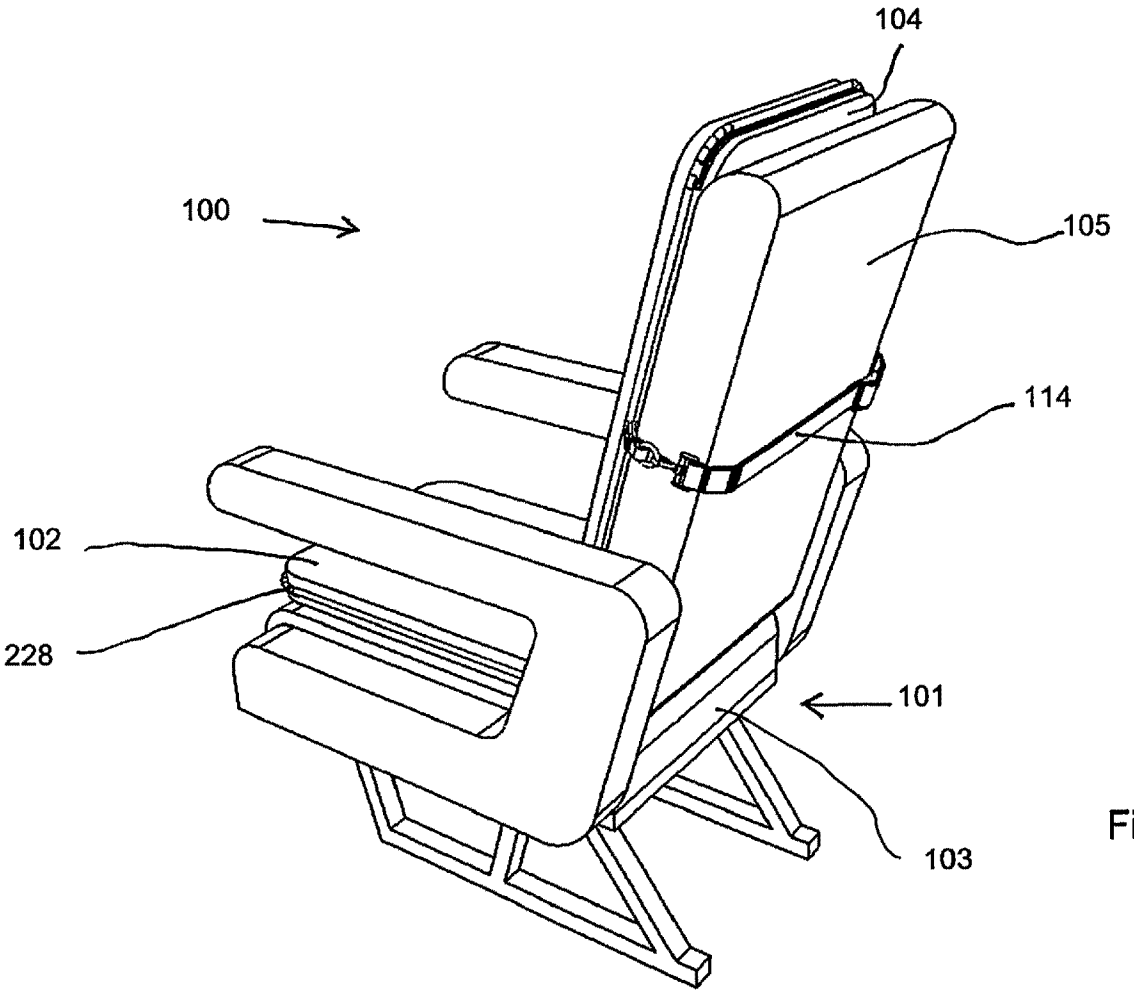
Figure 4:
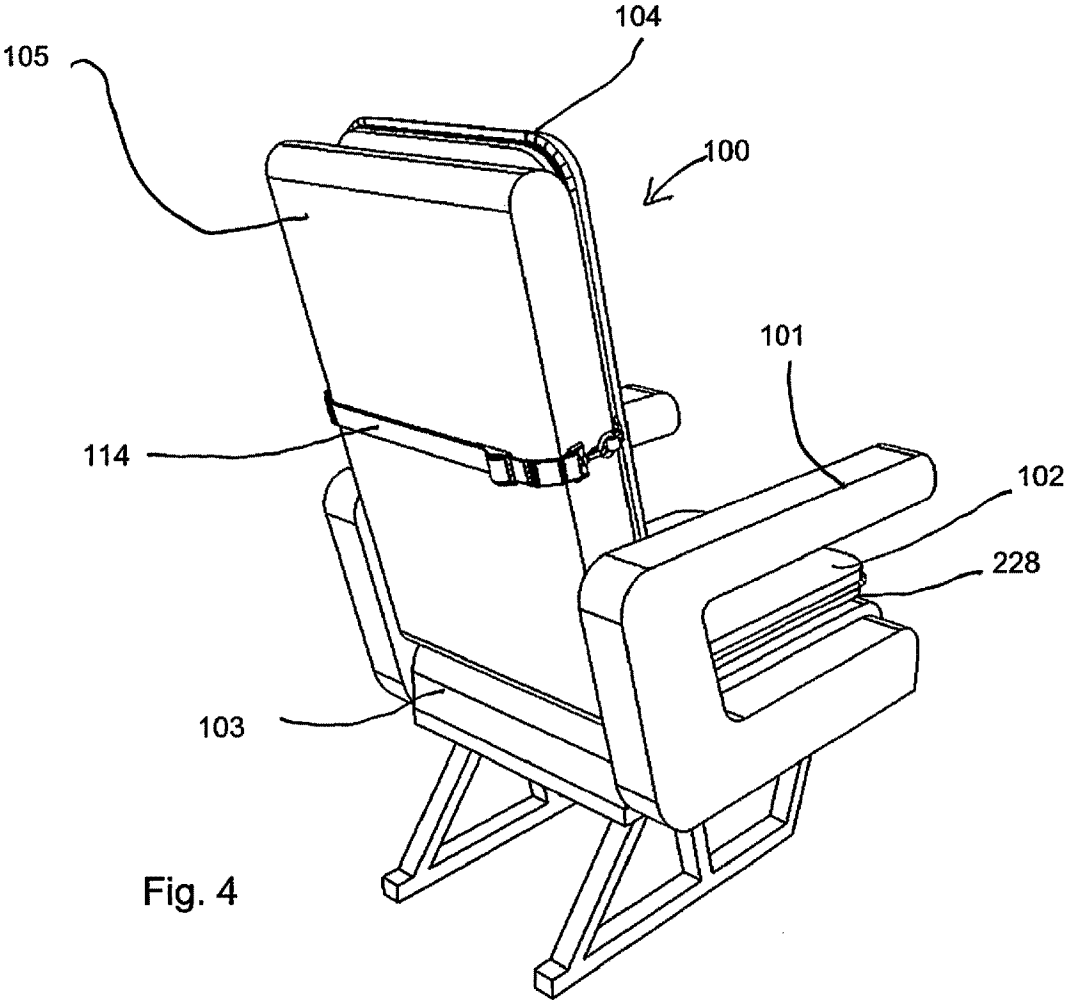
Figure 5:
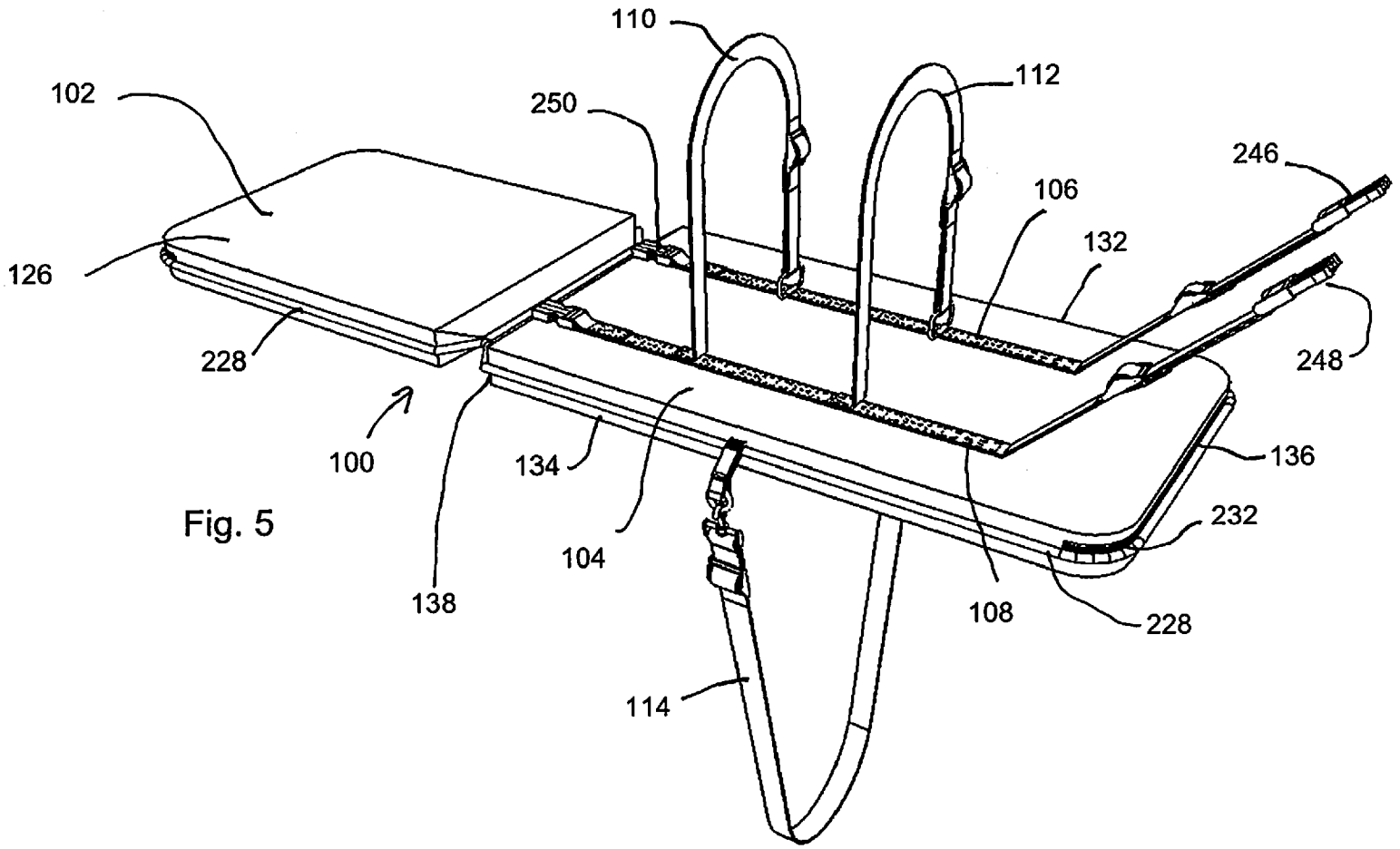
FIGS. 5-9 are views of a portable seat cushion according to the present invention.
Figure 6:
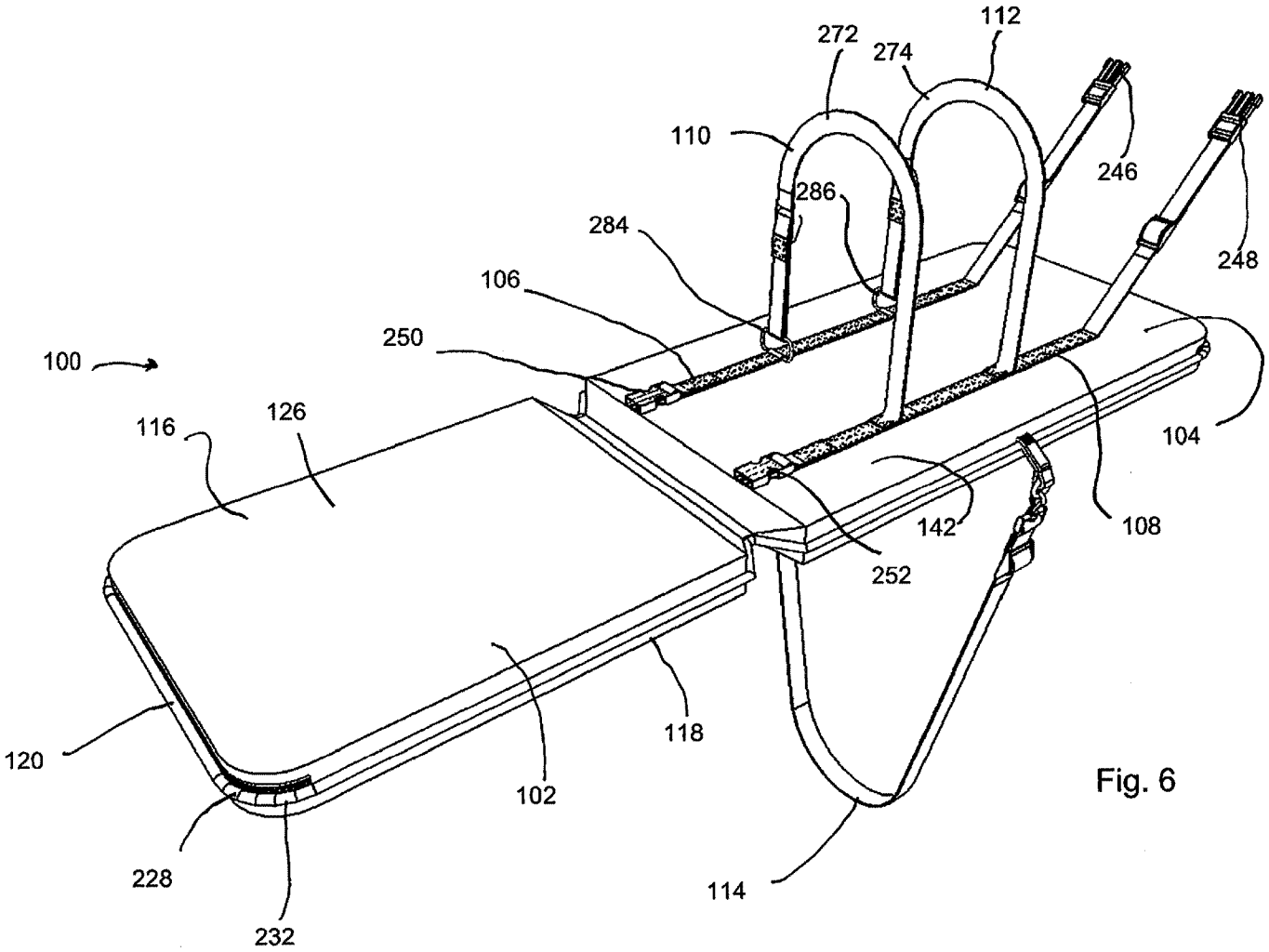
Figure 7:
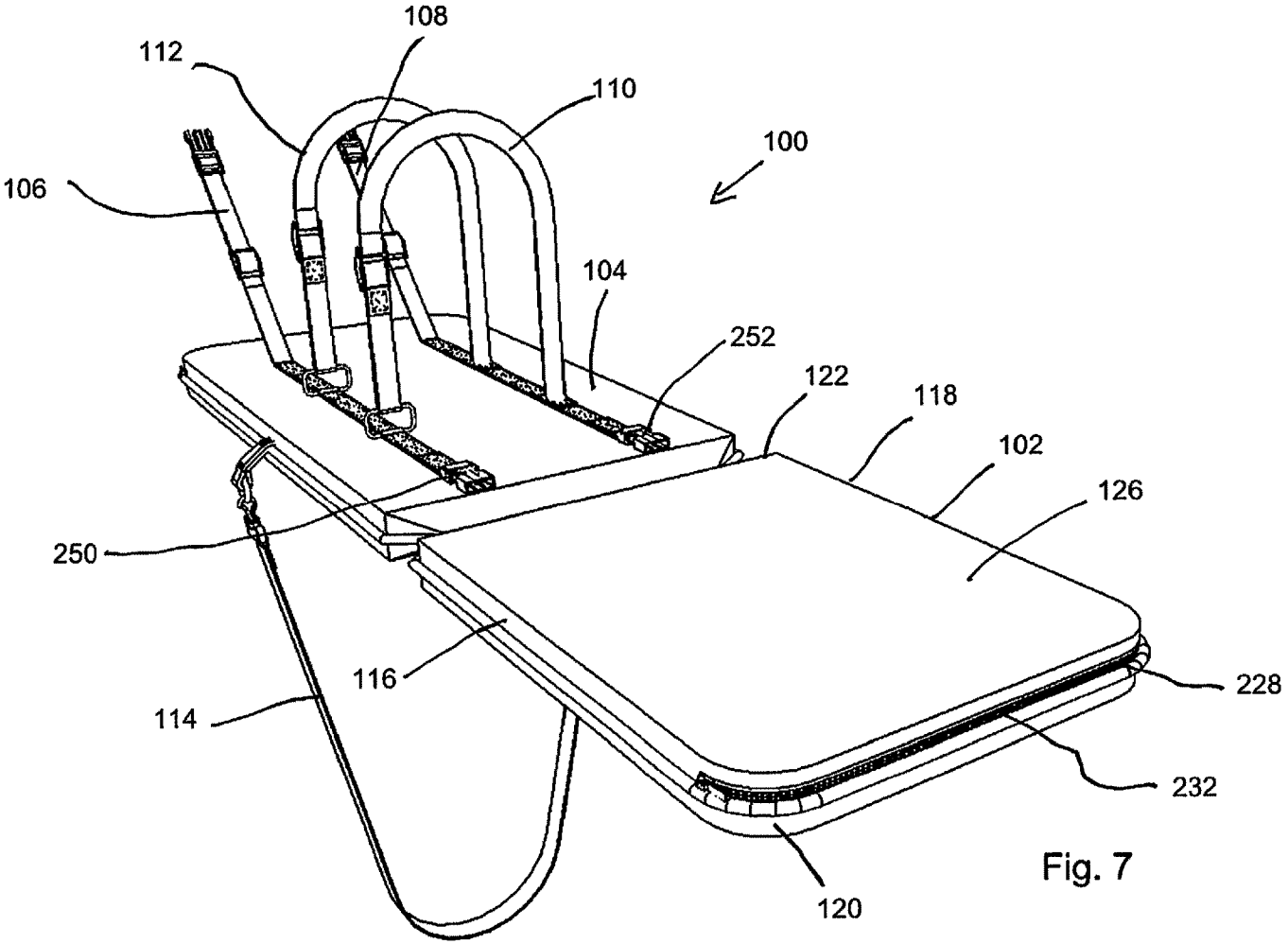
Figure 8:
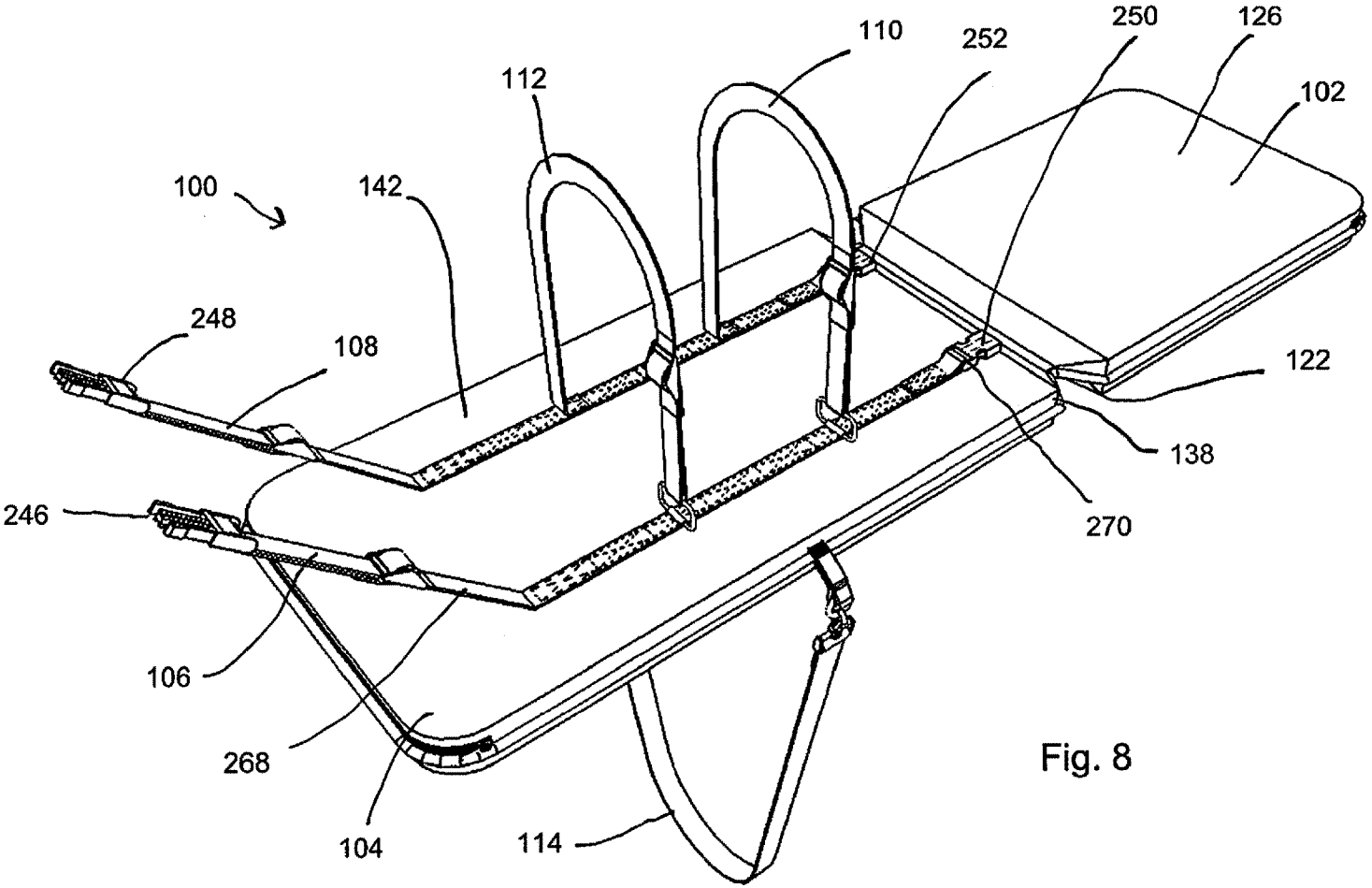
Figure 9:
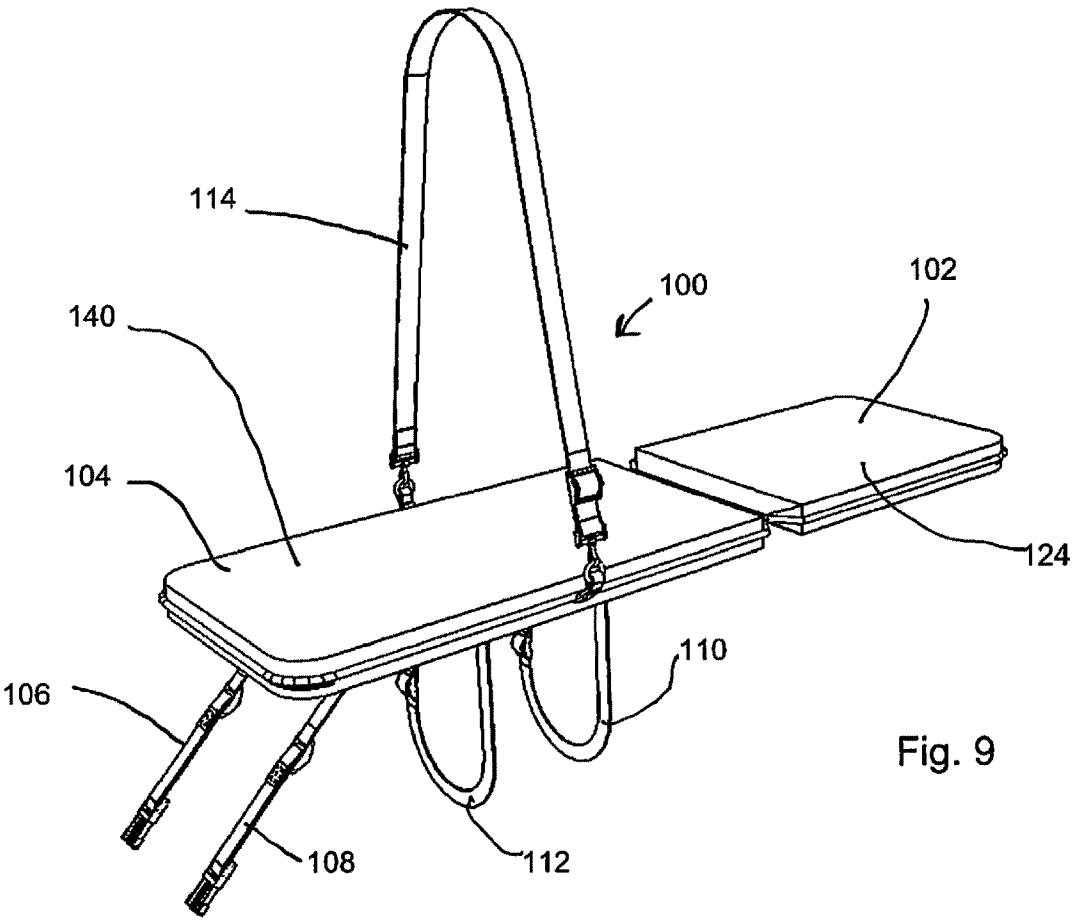
Figure 10:
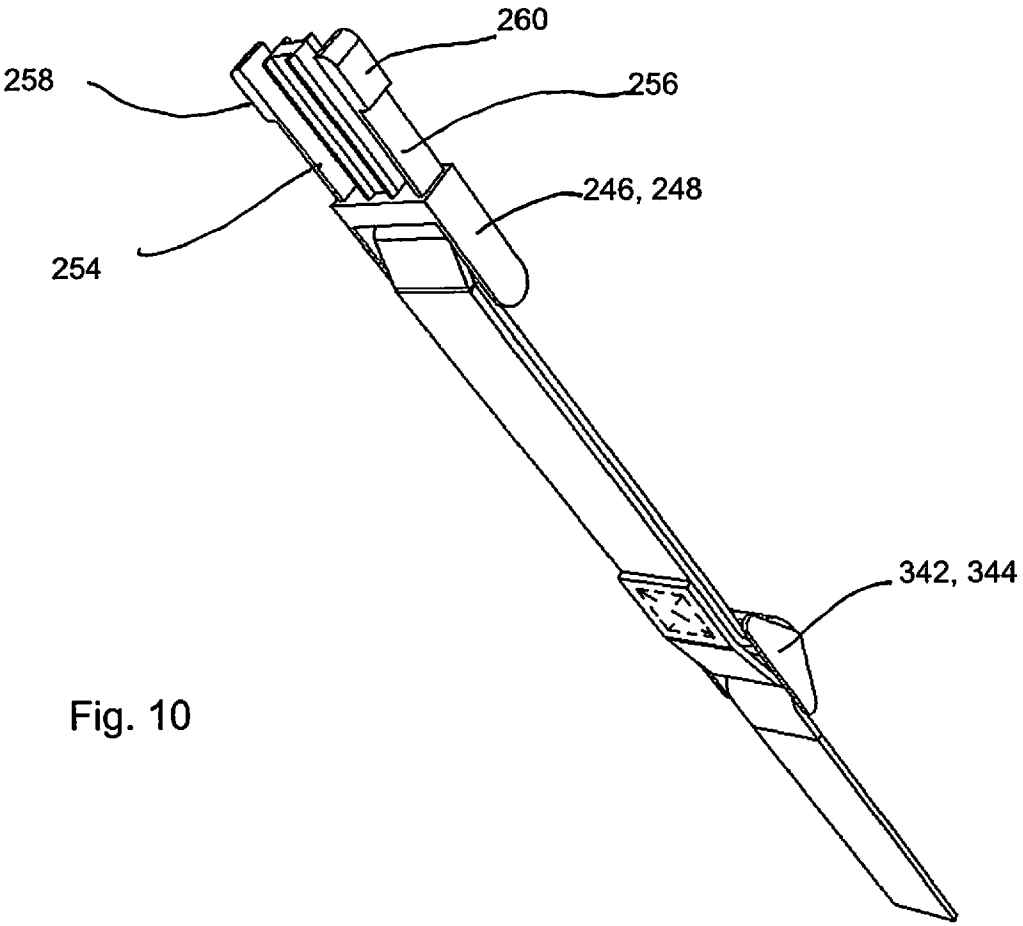
FIGS. 10-12 show details of the buckle system for holding a portable seat cushion according to the present invention in the rolled-up configuration.
Figure 11A:
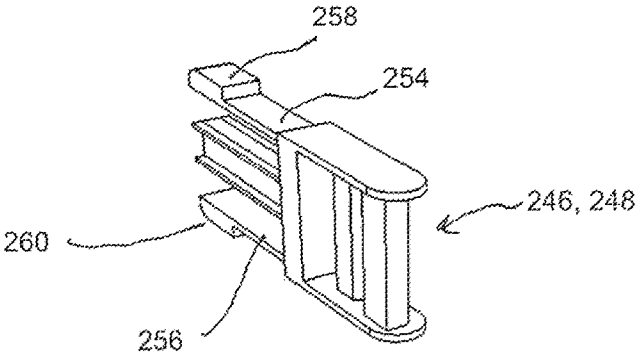
Figure 11B:
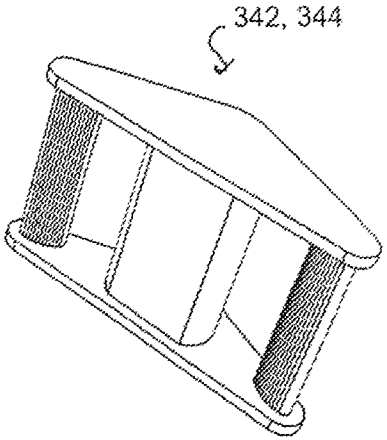
Figure 12:
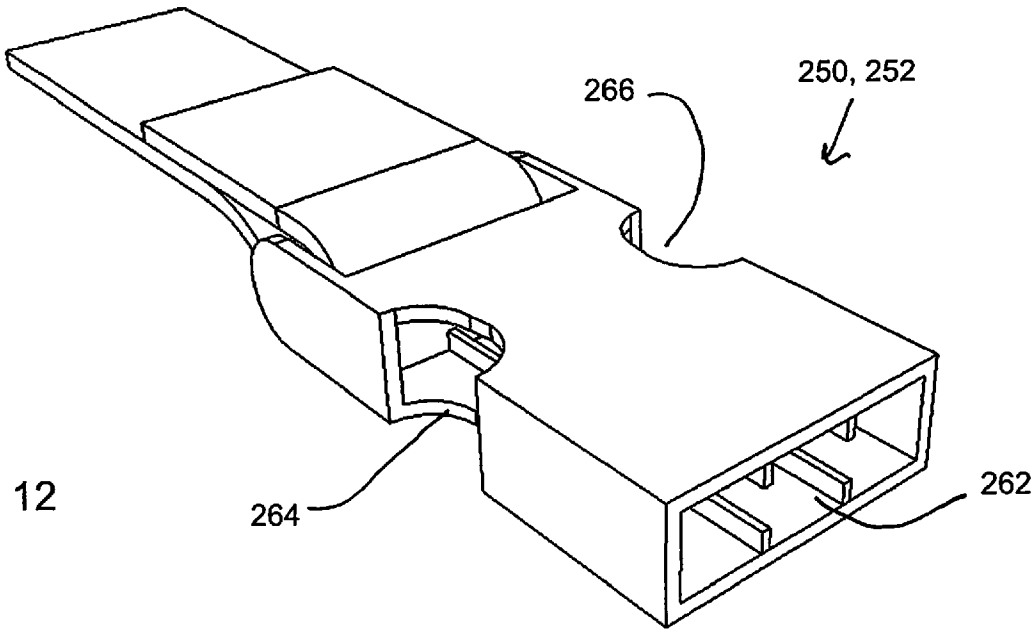
Figure 13:
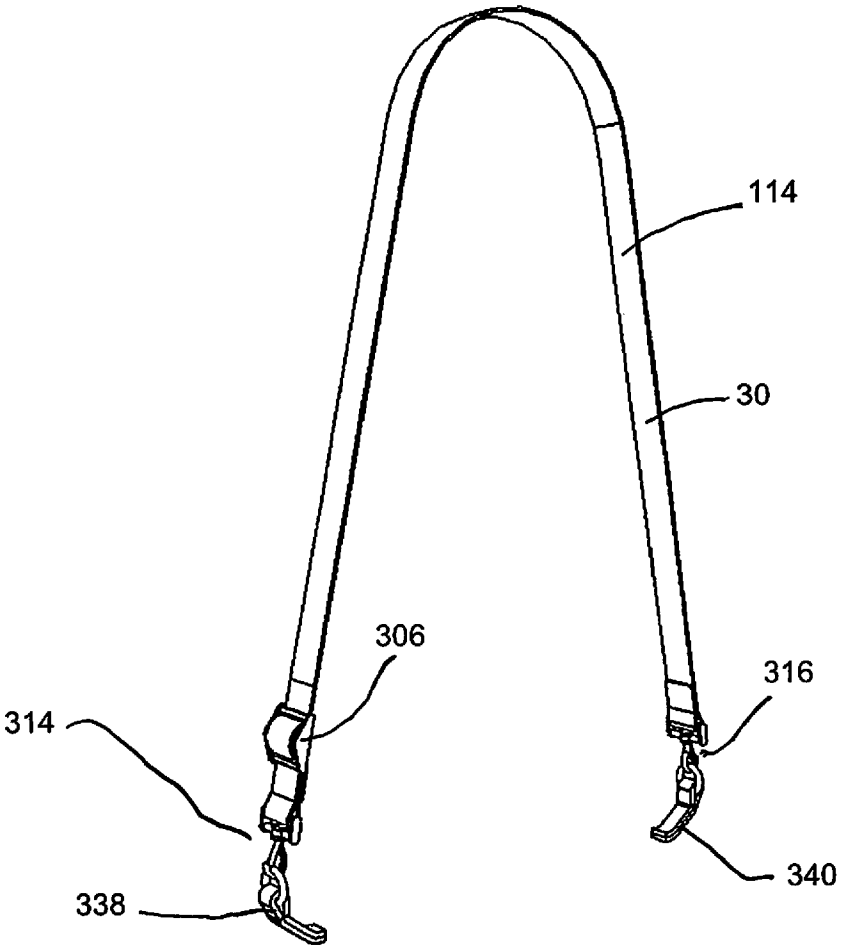
FIGS. 13-15C show details of the shoulder strap for a portable seat cushion according to the present invention.
Figure 14B:
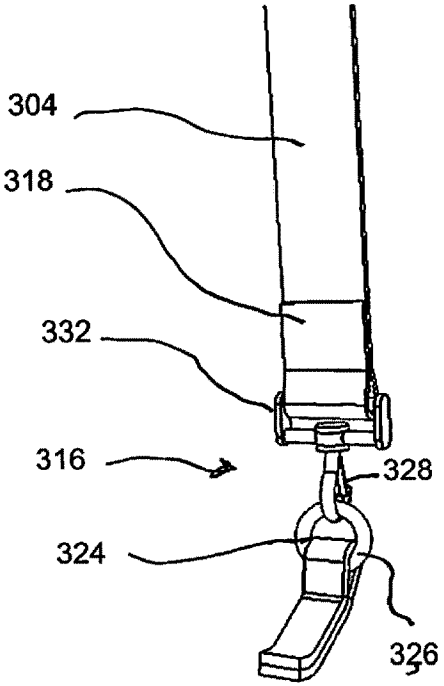
Figure 14A:
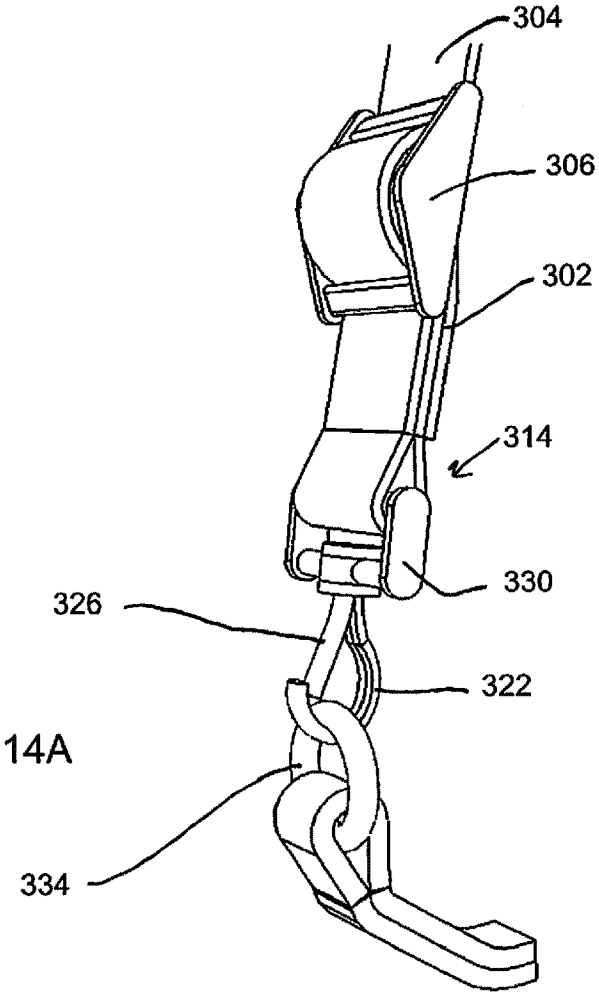
Figure 15C:
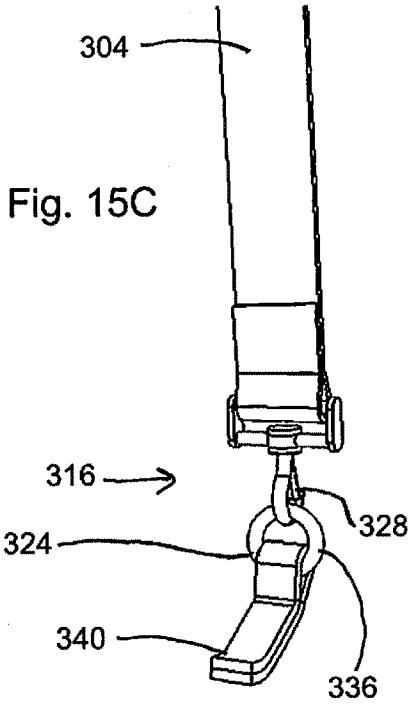
Figure 15B:
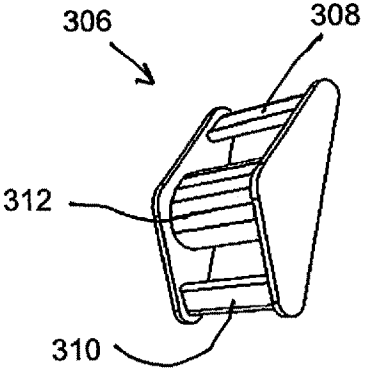
Figure 15A:
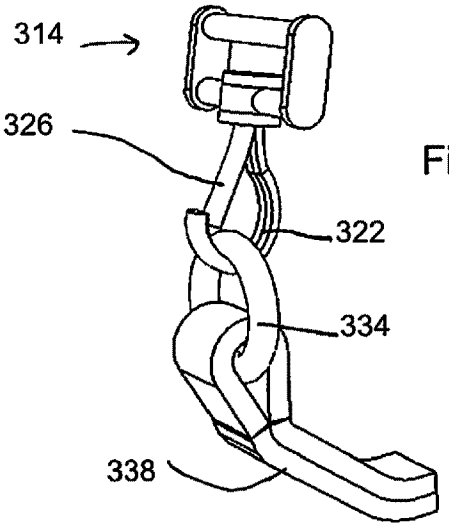
Figure 16:
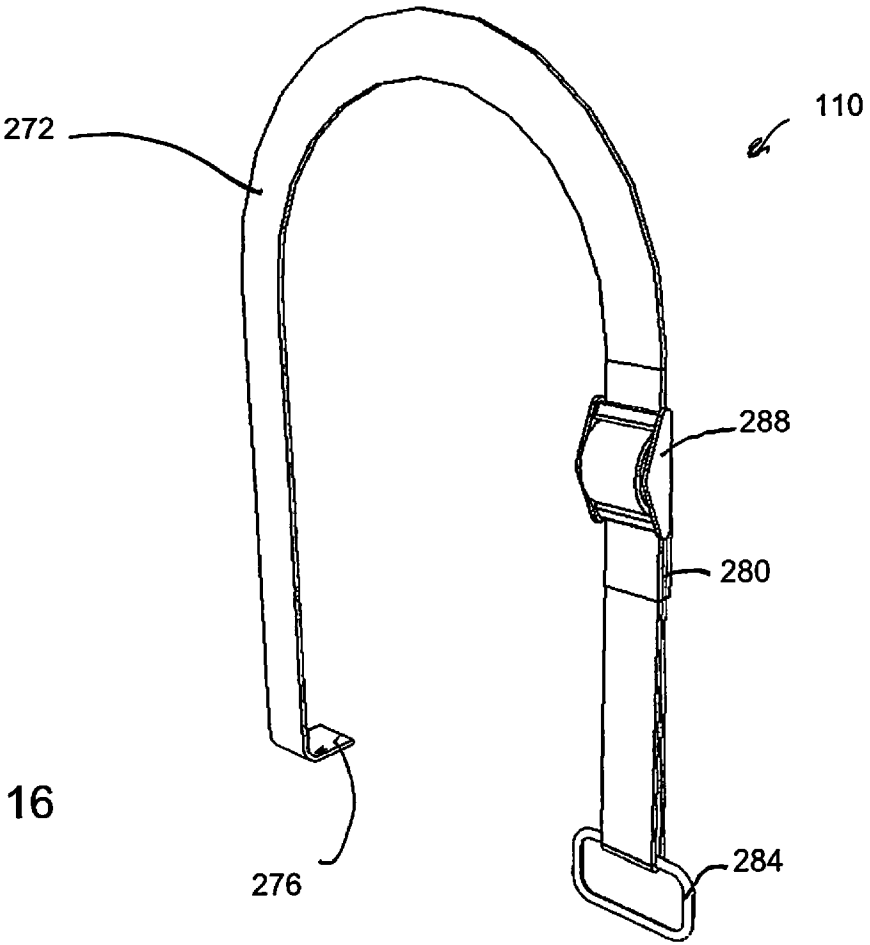
FIGS. 16-17C show details of the handle straps for a portable seat cushion according to the present invention.
Figure 17A:
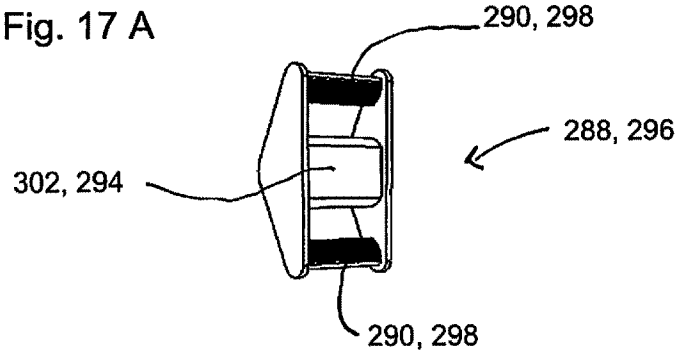
Figure 17B:
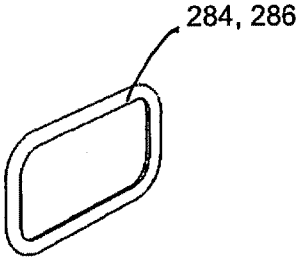
Figure 17C:
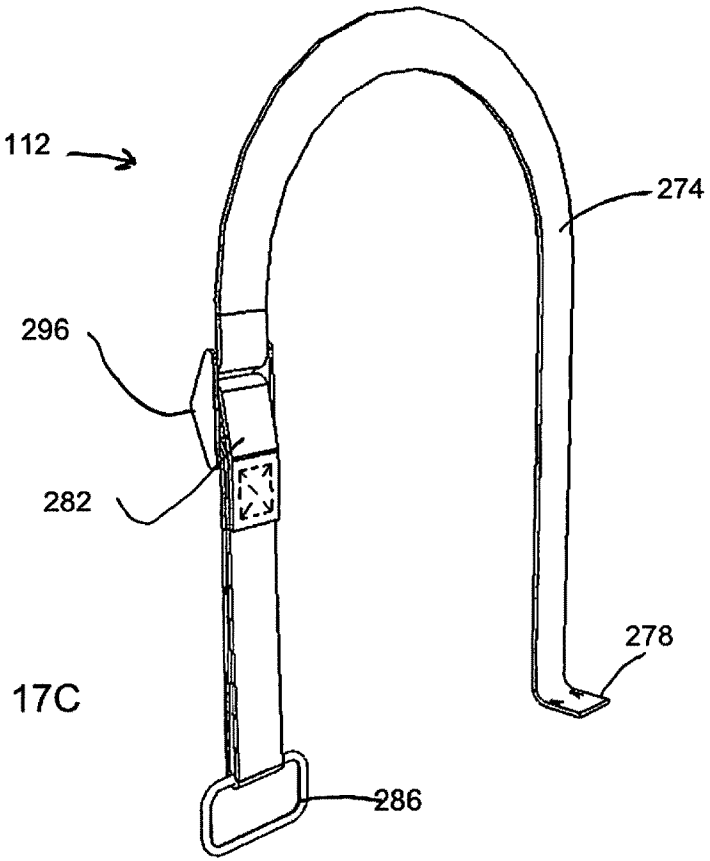
Figure 18:
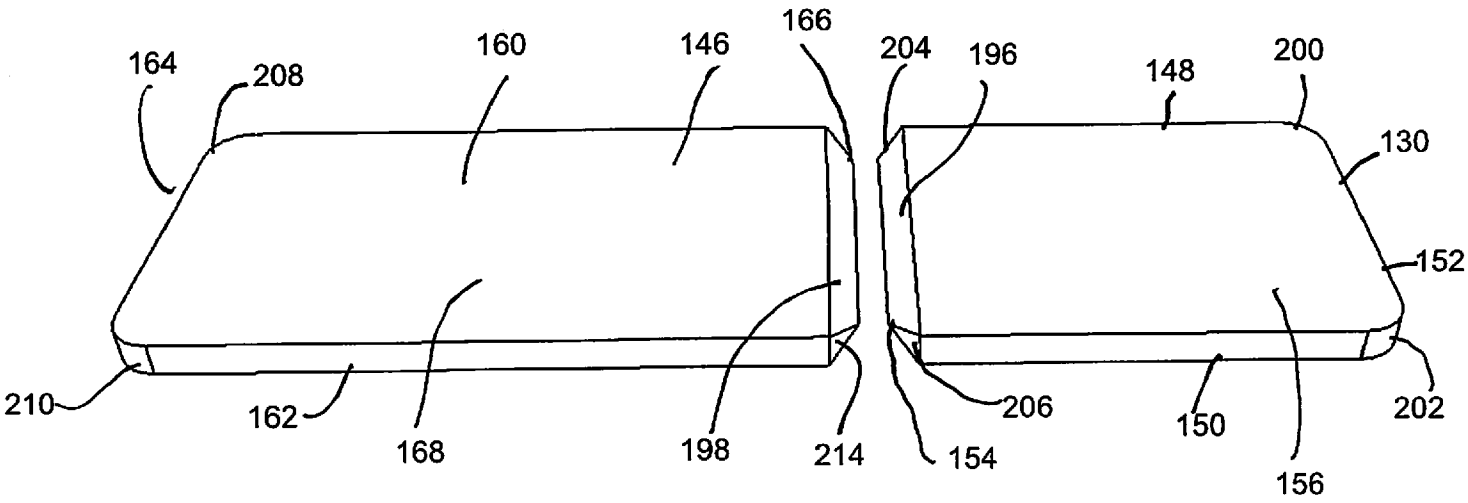
FIGS. 18-19 are views of the seat and back cushion inserts for a portable seat cushion according to the present invention.
Figure 19:
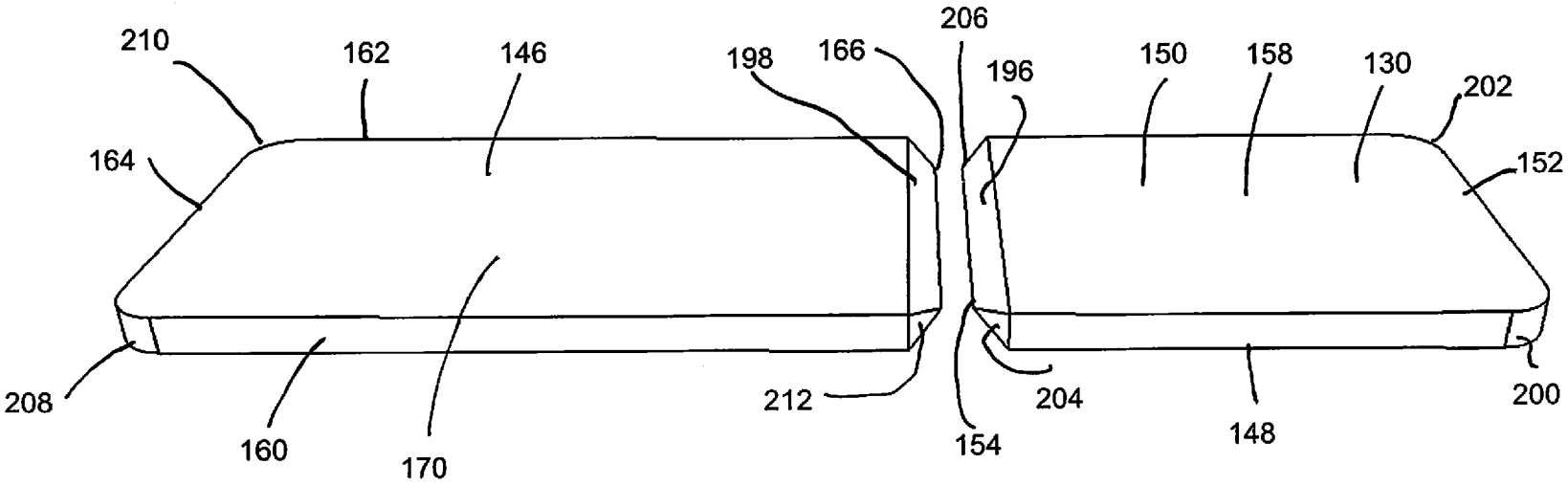
Figure 20:
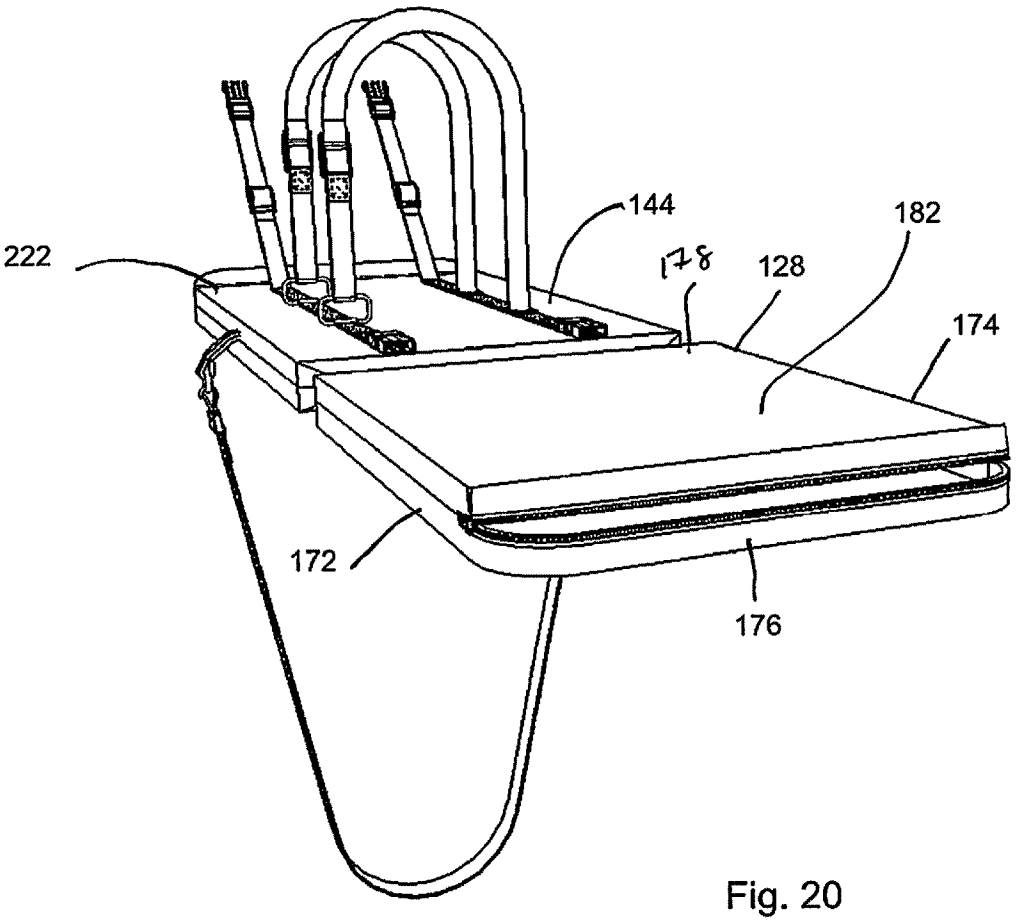
FIGS. 20-23 are views of the cover for a portable seat cushion according to the present invention.
Figure 21:
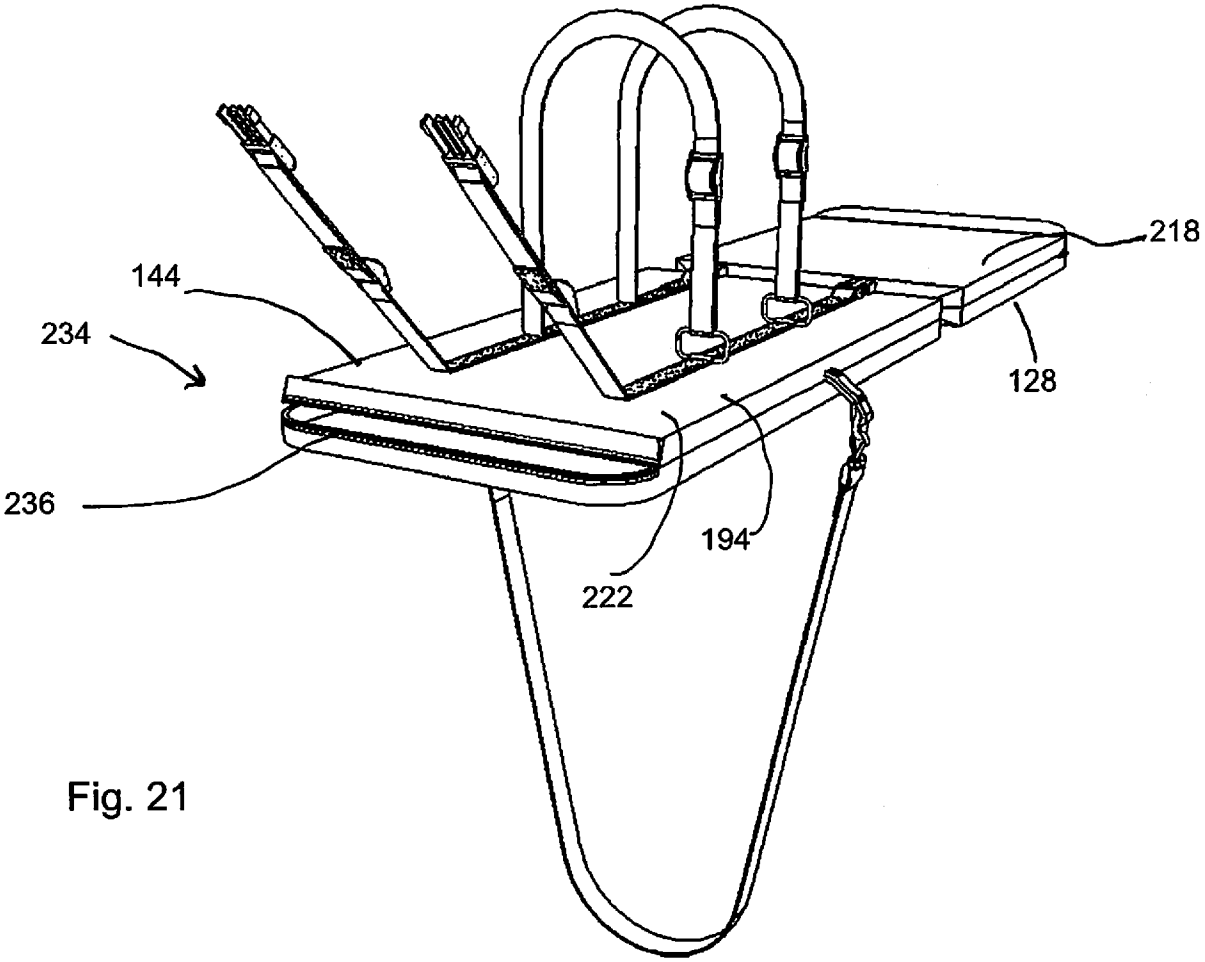
Figure 22:
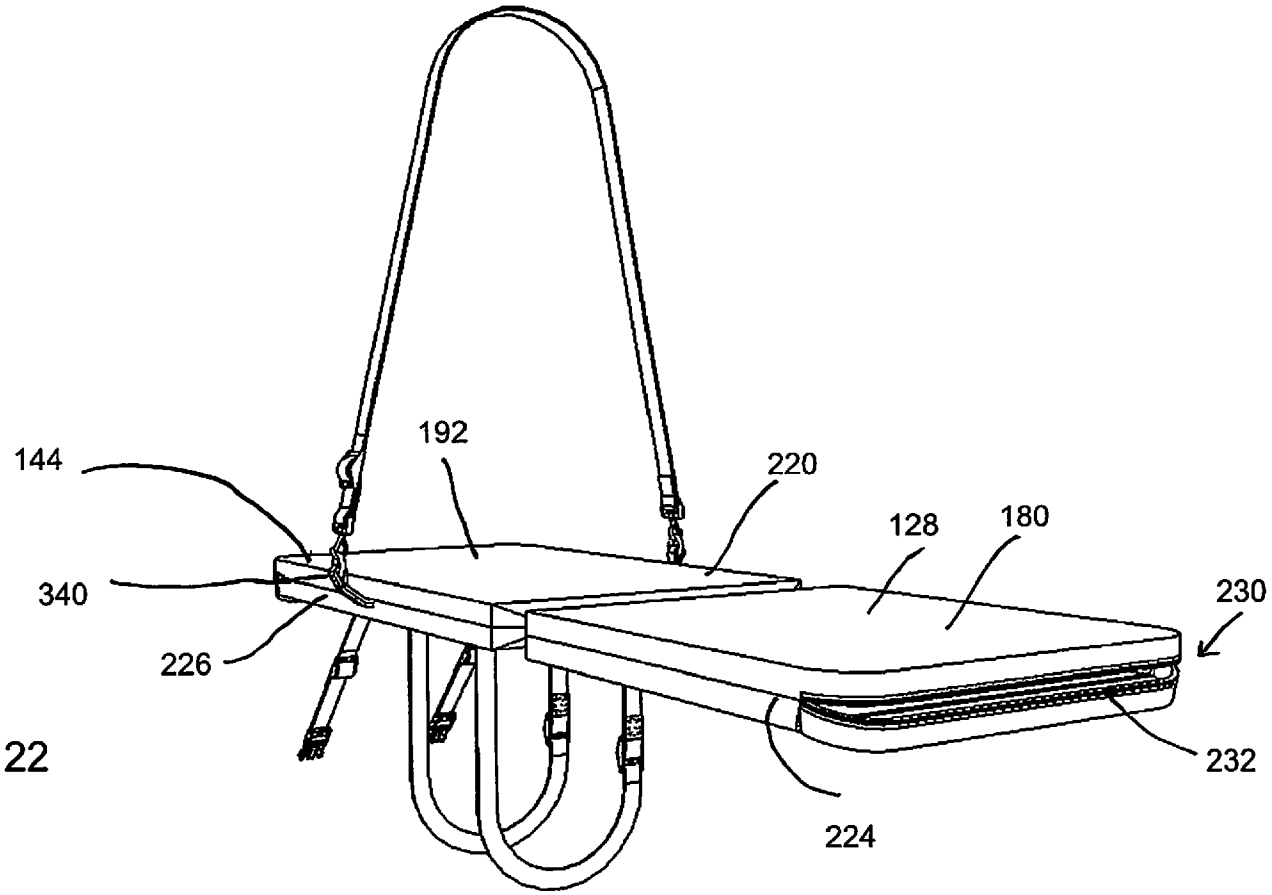
Figure 23:
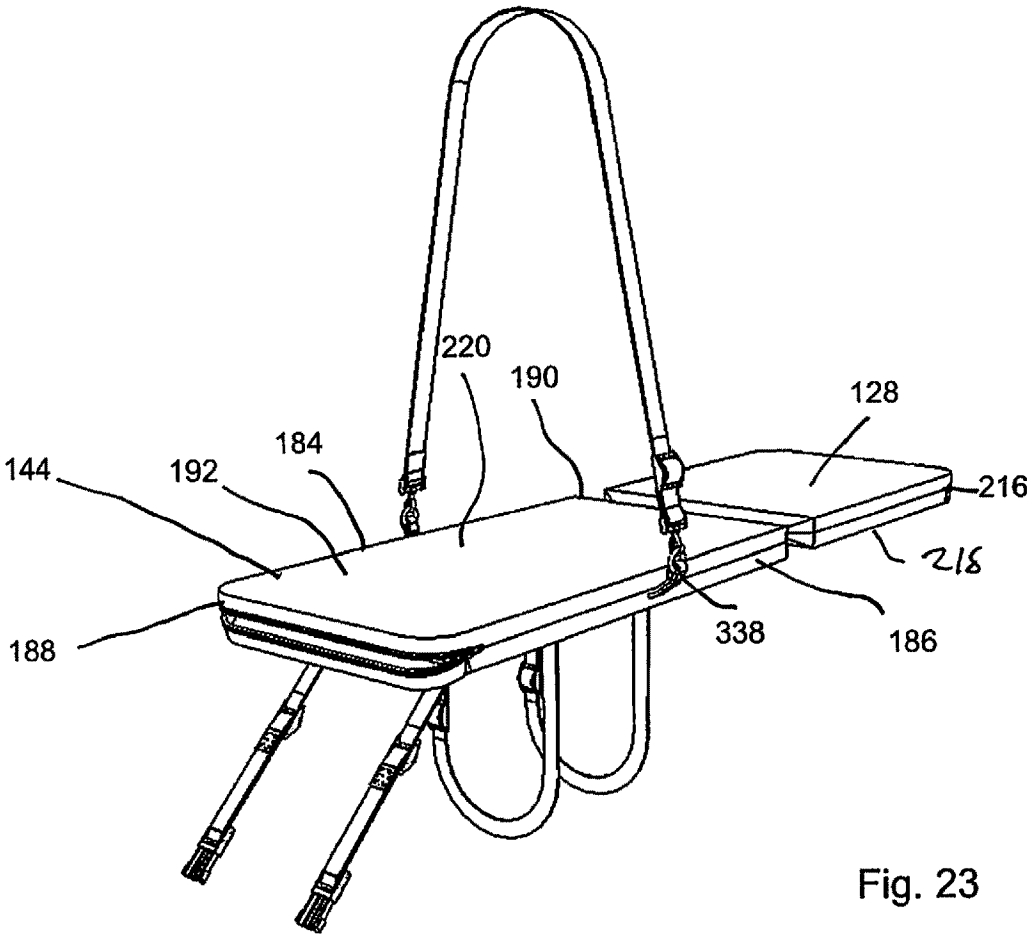
Figure 24:
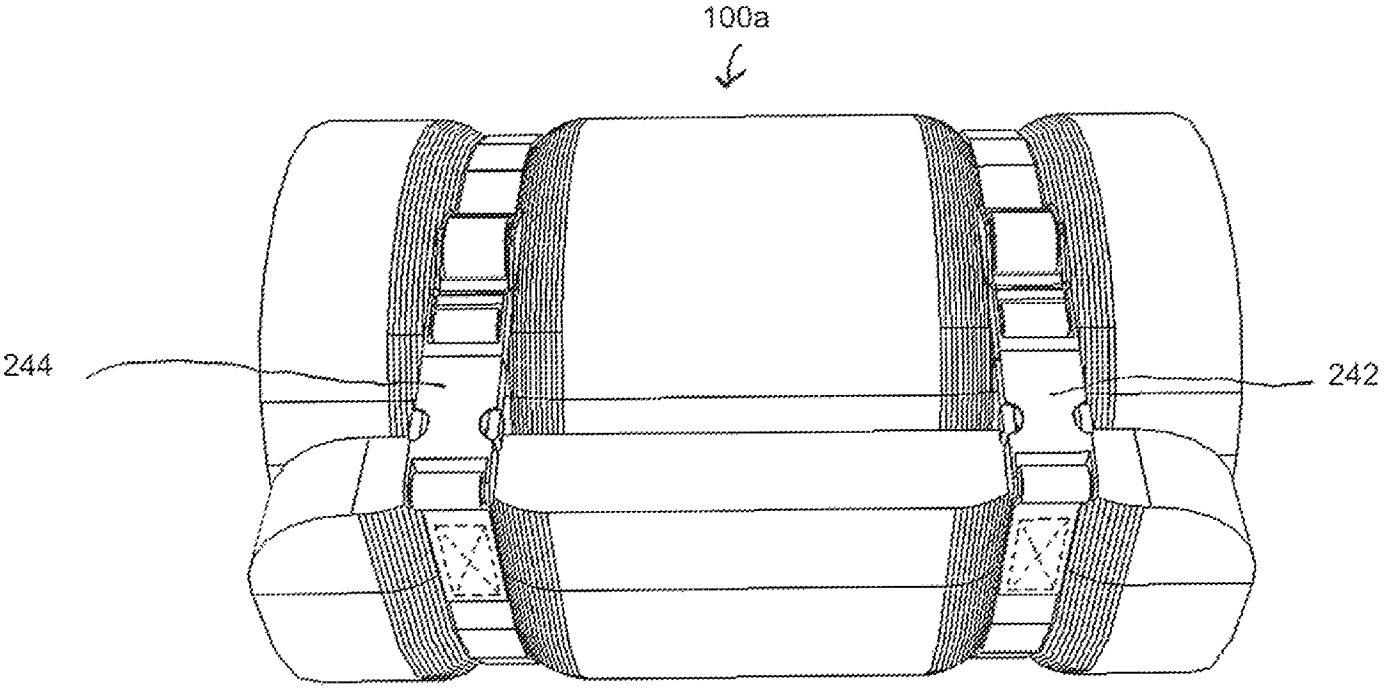
FIG. 24 shows an isometric view of a portable seat cushion according to the present invention in the rolled-up configuration with details such as the shoulder straps, handles, and welting omitted in the interest of clarity.

Referring to FIGS. 1-24, an illustrative embodiment of a portable seat cushion 100 in accordance with the present invention can be seen. The portable seat cushion 100 includes a seat or seat portion 102 and a back or back portion 104. The portable seat cushion 100 is configured for being rolled up into a rolled-up configuration, as shown in FIG. 24, for easy transportation. The portable seat cushion 100 also includes a first strap 106 and a second strap 108 that serve to secure and maintain the portable seat cushion 100 in the rolled-up configuration. The portable seat cushion 100 also includes a pair of carrying handles 110 and 112 that allow the portable seat cushion 100 to be hand carried when it is in the rolled-up configuration.

The portable seat cushion 100 also includes a shoulder strap 114 that allows the portable seat cushion 100 to be carried with the shoulder strap 114 slung over a person's shoulder. The shoulder over which the shoulder strap 114 is slung can be on the same or the opposite side of the person's body relative to the side of the person's body on which the rolled-up portable seat cushion 100 is being carried. The length of said shoulder strap 114 is adjustable.

To use the portable seat cushion 100, the first and second straps 106, 108 are unfastened and then the portable seat cushion 100 is unrolled. Then the seat 102 of the portable seat cushion 100 is placed over the seat 103 of the chair or seat 101 to which the portable seat cushion 100 is being applied, while the back 104 of the portable seat cushion 100 is placed against the back 105 of the chair or seat 101 such that the first and second straps 106, 108 and the carrying handles 110, 112 are positioned between the back 104 of the portable seat cushion 100 and the back 105 of the chair or seat 101. The shoulder strap 114 is then placed around the back 105 of the chair or seat 101 with both terminal portions of the shoulder strap 114 being attached to the back 104 of the portable seat cushion 100 with the terminal portions being attached to the back 104 of the portable seat cushion 100 on opposite sides. The shoulder strap 114 is then cinched around the back 105 of the chair or seat 101 to securely hold the portable seat cushion 100 in place on the chair or seat 101. A person can then sit on the chair or seat 101 with the portable seat cushion 100 positioned between the person and the chair or seat 101. The portable seat cushion 100 will then provide added cushioning, and consequently added comfort, for the person sitting on the chair or seat 101. In the illustrated example, the chair or seat 101 is an airline passenger seat.

The seat 102 has a left side 116, a right side 118, a front side 120, a rear side 122, a top surface 124, and a bottom surface 126. The seat 102 includes a seat cover 128 and a seat cushion insert 130. The seat cover 128 forms a pocket for receiving and enclosing the seat cushion insert 130.

The back 104 has a left side 132, a right side 134, a top side 136, a bottom side 138, a front surface 140, and a rear surface 142. The back 104 includes a back cover 144 and a back cushion insert 146. The back cover 144 forms a pocket for receiving and enclosing the back cushion insert 146.

The seat 102 is attached to the back 104 by the rear side 122 of the seat being attached to the bottom side 138 of the back. The seat cushion insert 130 has a left side 148, a right side 150, a front side 152, a rear side 154, a top surface 156, and a bottom surface 158. The back cushion insert 146 has a left side 160, a right side 162, a top side 164, a bottom side 166, a front surface 168, and a rear surface 170. The seat cushion 100 can be rolled up into a rolled-up configuration for ease of portability.

In the illustrated example, the seat cushion insert 130 and the back cushion insert 146 are made of memory foam. Preferably, the seat cushion insert 130 and the back cushion insert 146 are made of high density memory foam.

The seat cover 128 has a left side 172, a right side 174, a front side 176, a rear side 178, a top surface 180, and a bottom surface 182. The back cover 144 has a left side 184, a right side 186, a top side 188, a bottom side 190, a front surface 192, and a rear surface 194. The seat 102 is attached to the back 104 by the seat cover 128 being attached to the back cover 144. The seat cover 128 is attached to the back cover 144 by the rear side 178 of the seat cover 128 being attached to the bottom side 190 of the back cover 144.

The seat cover 128 may be attached to the back cover 144 by the rear side 178 of the seat cover 128 being sewn to the bottom side 190 of the back cover 144. Alternatively, the seat cover 128 and the back cover 144 may be made of one elongated sleeve that is divided into a compartment for the seat cushion insert 130 and a compartment for the back cushion insert 146 by stitching or other means provided along the line of attachment between the rear side of the seat cover 128 and the bottom side of the back cover 144.

The seat cushion insert 130 has a tapering portion 196 that is coextensive with the rear side of the seat cushion insert 130 such that the tapering portion of the seat cushion insert is of a decreasing thickness in the direction of the rear side 154 of the seat cushion insert 130. Thus, the seat cushion insert 130 has an approximately wedge-shaped cross section proximate the rear side 154 of the seat cushion insert 130. The back cushion insert 146 has a tapering portion 198 that is coextensive with the bottom side 166 of the back cushion insert such that the tapering portion of the back cushion insert 146 is of a decreasing thickness in the direction of the bottom side 166 of the back cushion insert 146 and the back cushion insert 146 has an approximately wedge-shaped cross section proximate the bottom side 166 of the back cushion insert 146.

The seat cushion insert 130 has a first rounded corner 200 connecting the left side 148 of the seat cushion insert to the front side 152 of the seat cushion insert. The seat cushion insert 130 has a second rounded corner 202 connecting the right side 150 of the seat cushion insert to the front side 152 of the seat cushion insert. The seat cushion insert 130 has a first beveled corner 204 connecting the left side 148 of the seat cushion insert to the rear side 154 of the seat cushion insert, and the seat cushion insert 130 has a second beveled corner 206 connecting the right side 150 of the seat cushion insert to the rear side 154 of the seat cushion insert. The tapering portions allow for easier bending or folding between the seat 102 and the back 104.

The back cushion insert 146 has a first rounded corner 208 connecting the left side 160 of the back cushion insert 146 to the top side 164 of the back cushion insert. The back cushion insert 146 has a second rounded corner 210 connecting the right side 162 of the back cushion insert to the top side 164 of the back cushion insert. The back cushion insert 146 has a first beveled corner 212 connecting the left side 160 of the back cushion insert to the bottom side 166 of the back cushion insert, and the back cushion insert 146 has a second beveled corner 214 connecting the right side 162 of the back cushion insert to the bottom side 166 of the back cushion insert. The back cushion insert 146 is longer than the seat cushion insert 130.

The seat cover 128 includes a top seat panel 216 and a bottom seat panel 218, which are made of a woven fabric. The top seat panel 216 and the bottom seat panel 218 are sewn together, at least along portions of each of the top seat panel 216 and the bottom seat panel 218 proximate the perimeter of each of the top seat panel 216 and the bottom seat panel 218, to form the pocket for receiving the seat cushion insert 130. The back cover 144 includes a front back panel 220 and a rear back panel 222, which are made of a woven fabric. The front back panel 220 and the rear back panel 222 are sewn together, at least along portions of each of the front back panel 220 and the rear back panel 222 proximate the perimeter of each of the front back panel 220 and the rear back panel 222, to form the pocket for receiving the back cushion insert 146.

The seat cover 128 has a seam 224 extending along the left side 172, the right side 174, and the front side 176 of the seat cover 128. The back cover 144 has a seam 226 extending along the left side 184, the right side 186, and the top side 188 of the back cover 144. The seam 224 of the seat cover 128 is contiguous with the seam 226 of the back cover 144. The seam of the seat cover 128 and the seam of the back cover 144 are reinforced by a welt bead or welt piping 228 extending continuously along the left side 172, the right side 174, and the front side 176 of the seat cover 128 and along the left side 184, the right side 186, and the top side 188 of the back cover 144.

The seat cover 128 has an opening 230 for the insertion of the seat cushion insert 130, and the opening 230 of the seat cover 128 is provided with a first zipper closure 232 for selectively opening and closing the opening 230 of the seat cover 128. The back cover 144 has an opening 234 for the insertion of the back cushion insert 146, and the opening 234 of the back cover 144 is provided with a second zipper closure 236 for selectively opening and closing the opening 234 of the back cover 144.

The opening 230 of the seat cover 128 is coextensive with at least a majority of the front side 120 of the seat 102 and is located below the welt piping 228 on the same side of the welt piping as the bottom seat panel 218. The opening 234 of the back cover 144 is coextensive with at least a majority of the top side 136 of the back 104 and is located on the same side of the welt piping 228 as the rear back panel 222. The opening 230 of the seat cover 128 is more preferably coextensive with at least the front side 120 of the seat 102, and the opening 234 of the back cover 144 is more preferably coextensive with at least the top side 136 of the back 104. The welt piping is preferably made of a plastic, for example, PVC.

The portable seat cushion 100 is configured, by the seat cushion insert 130 and the back cushion insert 146 each being sufficiently thin, to allow the portable seat cushion to be rolled up into a roll and form a rolled-up portable seat cushion **100*a* with the seat 102 being rolled up inside the back 104, such that the rear back panel 222 is positioned around or on the outside of the rolled-up portable seat cushion 100*a*. The rolled-up portable seat cushion 100*a* is also referred to herein as the rolled-up configuration of the portable seat cushion. The portable seat cushion 100 further includes a pair of straps 106 and 108 each having a first end and a second end. Each of the straps 106, 108 is long enough so that each of the straps 106, 108 can be placed around the rolled-up portable seat cushion 100*a* and the first end and the second end of each of the straps 106, 108 are configured to be fastened together to hold the rolled-up portable seat cushion 100***a* in the rolled-up configuration.

In the illustrated example, each of the straps 106, 108 is provided with a side-release buckle system 242 and 244, respectively. Each buckle system 242 or 244 is a two part buckle system including a plug 246, 248 and a socket 250, 252. Each plug 246, 248 has two resilient prongs 254, 256, and each prong 254, 256 has a lateral protuberance 258, 260. Each socket 250, 252 has one or more channels 262 for receiving the prongs 254, 256. Each socket 250, 252 also has lateral openings 264, 266. Each of the lateral openings 264, 266 receives the lateral protuberance 258, 260 of a respective one of the prongs 254, 256 when the plug and the socket of the buckle system 242, 244 are fastened together. The prongs 254, 256 are pinched together through the lateral openings 264, 266 of the socket to release the plug from the socket and thus unfasten the buckle system 242, 244 in order to unroll the portable seat cushion 100.

Each of the straps 106, 108 is sewn to the rear back panel 222 over at least a portion of each of the straps. The straps 106, 108 are positioned on the rear back panel 222 in parallel to each other, while the straps 106, 108 are spaced apart from each other.

Other fastening means can be provided at the ends of the straps 106, 108. The first end of each of the straps 106, 108 can be provided with a fastening means selected from a hook and loop fastener portion, a buckle, a side-release buckle plug, a side-release buckle socket, a length of free strap, a strap adjuster, a ring, and a snap hook. The second end of each of the straps 106, 108 can be provided with a fastening means selected from a hook and loop fastener portion, a buckle, a side-release buckle plug, a side-release buckle socket, a length of free strap, a strap adjuster, a ring, and a snap hook, that is complementary to the fastening means provided at the first end of the particular strap 106, 108.

The length of each of the straps 106, 108 extending between the portion 268, 270 of each of the straps that is sewn to the rear back panel 222 and at least one of the fastening means provided at the first and second ends of each of the straps 106, 108 is adjustable. In the illustrated example, strap slides 342, 344 are provide on the portion of the straps 106, 108 proximate the plugs 246, 248 to allow for the lengths of the straps 106, 108 to be adjusted. The strap slides 342, 344 function in the same way as the strap slides 288 and 296, and the straps 106, 108 are routed through the straps slides 342, 344 in the same manner as the carrying handle straps 272 and 274 are routed through the strap slides 288 and 296.

The portable seat cushion 100 also includes a first carrying handle 110 and a second carrying handle 112, as already mentioned. The first carrying handle 110 is formed by a first carrying handle strap 272. The second carrying handle 112 is formed by a second carrying handle strap 274. Each of the first carrying handle strap 272 and the second carrying handle strap 274 have a first end 276, 278 and a second end 280, 282. The first carrying handle 110 and the second carrying handle 112 each have a length.

A first ring 284 is provided on the portion of the second strap 108 that is sewn to the rear back panel 222. A second ring 286 is also provided on the portion of the second strap 108 that is sewn to the rear back panel 222 at a location spaced apart from the first ring 284.

A first three bar strap slide 288 is provided on the first carrying handle strap 272 at a position along the first carrying handle strap 272. The first three bar strap slide 288 has two lateral bars 290, 292 and a middle bar 294. A second three bar strap slide 296 is provided on the second carrying handle strap 274 at a position along the second carrying handle strap 274. The second three bar strap slide 296 has two lateral bars 298, 300 and a middle bar 302.

The first end 276 of the first carrying handle strap 272 and the first end 278 of the second carrying handle strap 274 are attached to the portion of the first strap 106 that is sewn to the rear back panel 222 at locations that are spaced apart. A first portion of the first carrying handle strap 272 extends between the lateral bars 290, 292 and the middle bar 294 of the first strap slide 288 such that the first carrying handle strap 272 passes from one side of the first strap slide 288 to the other side, passes around the middle bar 294 of the first strap slide, and then passes back to the one initial side of the first strap slide 288. In other words, the first portion of the first carrying handle strap 272 extends through the space between a first lateral bar 290 and the middle bar 294 of the first strap slide 288, then extends around one side of the middle bar 294 of the first strap slide 288, and then passes through the space between the second lateral bar 292 of the first strap slide 288 and the middle bar 294 of the first strap slide 288 to emerge on the same side of the first strap slide 288 as it is on before it passes between the first lateral bar 290 and the middle bar 294 of the first strap slide 288.

The first carrying handle strap 272 extends further in a loop through the first ring 284 and returns to the first strap slide 288 and passes between the middle bar 294 of the first strap slide 288 and the first portion of the first carrying handle strap 272, which slaloms around the middle bar 294 and through the first strap slide 288, and is then sewn back on itself to thereby form a sleeve around the middle bar 294 of the first strap slide 288 and fix the first strap slide 288 to the second end 280 of the first carrying handle strap 272. The length of the first carrying handle 110 can be adjusted by adjusting the position of the first strap slide 288 along the first carrying handle strap 272 relative to the first end 276 of the first carrying handle strap 272.

A first portion of the second carrying handle strap 274 extends between the lateral bars 298, 300 and the middle bar 302 of the second strap slide 296 such that the second carrying handle strap 274 passes from one side of the second strap slide 296 to the other side, passes around the middle bar 302 of the second strap slide, and then passes back to the one initial side of the second strap slide 296. In other words, the first portion of the second carrying handle strap 274 extends through the space between a first lateral bar 298 and the middle bar 302 of the second strap slide 296, then extends around one side of the middle bar 302 of the second strap slide 296, and then passes through the space between the second lateral bar 300 of the second strap slide 296 and the middle bar 302 of the second strap slide 296 to emerge on the same side of the second strap slide 296 as it is on before it passes between the first lateral bar 298 and the middle bar 302 of the second strap slide 296.

The second carrying handle strap 274 extends further in a loop through the second ring 286 and returns to the second strap slide 296 and passes between the middle bar 302 of the second strap slide 296 and the first portion of the second carrying handle strap 274, which slaloms around the middle bar 302 and through the second strap slide 296, and is then sewn back on itself to thereby form a sleeve around the middle bar 302 of the second strap slide 296 and fix the second strap slide 296 to the second end 282 of the second carrying handle strap 274. The length of the second carrying handle 112 can be adjusted by adjusting the position of the second strap slide 296 along the second carrying handle strap 274 relative to the first end 278 of the second carrying handle strap 274.

The portable seat cushion 100 is placed on a seat or chair 101, having a seat 103 and a back 105, between the seat or chair 101 and a person sitting on the seat or chair 101 to provide greater comfort to the person. The portable seat cushion 100 further includes a shoulder strap 114 that has a length. The shoulder strap 114 extends between attachment points on the left and right sides of the back of the portable seat cushion 100. The shoulder strap 114 is configured to allow over-the-shoulder carry of the portable seat cushion 100 when the portable seat cushion is in the rolled-up configuration 100*a*. The shoulder strap 114 is configured for being placed around the back 105 of a seat or chair 101 and cinched around the back 105 of the seat or chair 101 to thereby secure the portable seat cushion 100 to the seat or chair 101 with the seat of the portable seat cushion 100 being positioned over the seat 103 of the seat or chair 101 and the back of the portable seat cushion 100 being positioned over the back 105 of the seat or chair 101.

The shoulder strap 114 includes a flexible strap portion 304 that is made of Nylon, polyethylene, or polypropylene webbing. All the strap materials for the various straps of the disclosed embodiment are preferably also made of Nylon, polyethylene, or polypropylene webbing. The shoulder strap 114 also includes a shoulder strap slide 306 having first and second lateral bars 308, 310 and a middle bar 312. The shoulder strap 114 further includes first and second snap hooks 314 and 316.

Each of the snap hooks 314, 316 has a hook 322, 324, a tongue or latch 326, 328, and a connecting ring 330, 332. The latch 326, 328 keeps the hook 322, 324 securely fastened to the rings 334 or 336, and the latch 326, 328 must be depressed or pressed out of engagement with the tip of the hook 322, 324 to remove or release the snap hook 314, 316 from the ring 334, 336. Other types of fasteners such as carabiners, snap hooks with a sliding, spring-loaded latch, or the like may also be used with the present invention as alternatives to the snap hooks 314, 316.

The strap portion 304 has a first end 318 and a second end 320. A portion of the strap portion 304 including the second end 320 is wrapped around the middle bar 312 of the shoulder strap slide 306 and is then sewn back on itself to thereby form a sleeve around the middle bar 312 of the shoulder strap slide 306 and fix the shoulder strap slide 306 to the second end 320 of the strap portion 304. The strap portion 304 is the looped through the connecting ring of one of the snap hooks 314 and then passed back through the shoulder strap slide 306 such that the strap portion 304 extends through the space between a first lateral bar 308 and the middle bar 312 of the shoulder strap slide 306, passes around one side of the middle bar 312 of the shoulder strap slide 306, and then extends through the space between the second lateral bar 310 of the shoulder strap slide 306 and the middle bar 312 of the shoulder strap slide 306 to emerge on the same side of the shoulder strap slide 306 as it is on before it passes between the first lateral bar 308 and the middle bar 312 of the shoulder strap slide 306. A portion of the strap portion 304 including the first end 318 is positioned to extend through the connecting ring of the snap hook 316 and is then sewn back on itself to thereby fix the snap hook 316 to the first end 318 of the strap portion 304. The length of the strap portion 304, and consequently the length of the shoulder strap 114, can be adjusted by adjusting the position of the shoulder strap slide 306 along the strap portion 304 relative to the first end 318 of the strap portion 304.

In the illustrated embodiment, third and fourth rings 334 and 336 are provided on the left and right sides, respectively, of the back 104 for engagement by the snap hooks 314 and 316. Loops of strap material 338 and 340 extend through the rings 334 and 336, respectively. The loops of strap material 338 and 340 are attached to the left and right sides, respectively, of the back cover 144, and consequently to the left and right sides, respectively, of the back 104, to tether each of the rings 334 and 336 to the left and right sides, respectively, of the back 104. The rings 334 and 336 allow the ends of the shoulder strap 114 to be attached to the left and right sides of the back 104 using the snap hooks 314 and 316.

Zipper or zipper closure as used herein refers to a slide fastener of the type that employs a slide and two sets of interdigitating teeth distributed on either side of an opening to hold the opening closed. The slide is moved from one end of the opening to the other to disengage the two sets of teeth an allow access through the opening. The seat and back covers 128 and 144 are made of a woven fabric. The seat and back cushion inserts 130 and 146 have thicknesses in the range of from about one inch to about three inches. More preferably, seat and back cushion inserts 130 and 146 have thicknesses of about one inch.

It should be understood that the present invention is not limited to the specific embodiments described above, but includes any and all variations or modifications within the spirit and scope of the present invention as defined in the appended claims.

The invention claimed is:

1. A portable seat cushion comprising:

a seat having a left side, a right side, a front side, a rear side, a top surface, and a bottom surface, said seat including a seat cover and a seat cushion insert, said seat cover forming a pocket for receiving and enclosing said seat cushion insert; and a back having a left side, a right side, a top side, a bottom side, a front surface, and a rear surface, said back including a back cover and a back cushion insert, said back cover forming a pocket for receiving and enclosing said back cushion insert, wherein said seat is attached to said back by said rear side of said seat being attached to said bottom side of said back, wherein said seat cushion insert has a left side, a right side, a front side, a rear side, a top surface, and a bottom surface, wherein said back cushion insert has a left side, a right side, a top side, a bottom side, a front surface, and a rear surface, and wherein the seat cushion can be rolled up into a rolled-up configuration for ease of portability, wherein said seat cushion insert and said back cushion insert are made of memory foam;

wherein said seat cover has a left side, a right side, a front side, a rear side, a top surface, and a bottom surface, wherein said back cover has a left side, a right side, a top side, a bottom side, a front surface, and a rear surface, wherein said seat is attached to said back by said seat cover being attached to said back cover, and wherein said seat cover is attached to said back cover by said rear side of said seat cover being attached to said bottom side of said back cover; and wherein said seat cushion insert has a tapering portion that is coextensive with said rear side of said seat cushion insert such that said tapering portion of said seat cushion insert is of a decreasing thickness in the direction of said rear side of said seat cushion insert and said seat cushion insert has an approximately wedge-shaped cross section proximate said rear side of said seat cushion insert.

2. The portable seat cushion of claim 1, wherein said seat cushion insert and said back cushion insert are made of high density memory foam.

3. The portable seat cushion of claim 1, wherein said back cushion insert has a tapering portion that is coextensive with said bottom side of said back cushion insert such that said tapering portion of said back cushion insert is of a decreasing thickness in the direction of said bottom side of said back cushion insert and said back cushion insert has an approximately wedge-shaped cross section proximate said bottom side of said back cushion insert.

4. The portable seat cushion of claim 3, wherein said seat cushion insert has a first rounded corner connecting said left side of said seat cushion insert to said front side of said seat cushion insert, wherein said seat cushion insert has a second rounded corner connecting said right side of said seat cushion insert to said front side of said seat cushion insert, wherein said seat cushion insert has a first beveled corner connecting said left side of said seat cushion insert to said rear side of said seat cushion insert, and wherein said seat cushion insert has a second beveled corner connecting said right side of said seat cushion insert to said rear side of said seat cushion insert.

5. The portable seat cushion of claim 4, wherein said back cushion insert has a first rounded corner connecting said left side of said back cushion insert to said top side of said back cushion insert, wherein said back cushion insert has a second rounded corner connecting said right side of said back cushion insert to said top side of said back cushion insert, wherein said back cushion insert has a first beveled corner connecting said left side of said back cushion insert to said bottom side of said back cushion insert, and wherein said back cushion insert has a second beveled corner connecting said right side of said back cushion insert to said bottom side of said back cushion insert.

6. The portable seat cushion of claim 1, wherein said back cushion insert is longer than said seat cushion insert.

7. The portable seat cushion of claim 1, wherein said seat cover includes a top seat panel and a bottom seat panel, each made of a woven fabric and having a perimeter, that are sewn together, at least along portions of each of said top seat panel and said bottom seat panel proximate said perimeter of each of said top seat panel and said bottom seat panel, to form said pocket for receiving said seat cushion insert, and wherein said back cover includes a front back panel and a rear back panel, each made of a woven fabric and having a perimeter, that are sewn together, at least along portions of each of said front back panel and said rear back panel proximate said perimeter of each of said front back panel and said rear back panel, to form said pocket for receiving said back cushion insert.

8. The portable seat cushion of claim 7, wherein said seat cover has a seam extending along said left side, said right side, and said front side of said seat cover, wherein said back cover has a seam extending along said left side, said right side, and said top side of said back cover, wherein said seam of said seat cover is contiguous with said seam of said back cover, and wherein said seam of said seat cover and said seam of said back cover are reinforced by a welt bead or welt piping extending continuously along said left side, said right side, and said front side of said seat cover, and along said left side, said right side, and said top side of said back cover.

9. The portable seat cushion of claim 8, wherein said seat cover has an opening for the insertion of said seat cushion insert, and said opening of said seat cover being provided with a first zipper closure for selectively opening and closing said opening of said seat cover, and wherein said back cover has an opening for the insertion of said back cushion insert, and said opening of said back cover being provided with a second zipper closure for selectively opening and closing said opening of said back cover.

10. The portable seat cushion of claim 7, wherein the portable seat cushion is configured, by the seat cushion insert and the back cushion insert each being sufficiently thin, to allow the portable seat cushion to be rolled up into a roll and form a rolled-up portable seat cushion with said seat being rolled up inside said back, said roll having an outside, such that said rear back panel is positioned around the outside of the roll.

11. The portable seat cushion of claim 10, wherein said rolled-up portable seat cushion is in a rolled-up configuration, wherein the portable seat cushion further comprises a pair of straps each having a first end and a second end, and each of said straps being long enough so that each of said straps can be placed around the rolled-up portable seat cushion and said first end and said second end of each of said straps are configured to be fastened together to hold said rolled-up portable seat cushion in said rolled-up configuration.

12. The portable seat cushion of claim 11, wherein each of said straps is sewn to said rear back panel over at least a portion of each of said straps, said straps being positioned on said rear back panel in parallel to each other, and wherein said straps are spaced apart from each other.

13. The portable seat cushion of claim 12, wherein said first end of each of said straps is provided with a fastening means selected from a hook and loop fastener portion, a buckle, a side-release buckle plug, a side-release buckle socket, a length of free strap, a strap adjuster, a ring, and a snap hook, and wherein said second end of each of said straps is provided with a fastening means selected from a hook and loop fastener portion, a buckle, a side-release buckle plug, a side-release buckle socket, a length of free strap, a strap adjuster, a ring, and a snap hook, that is complementary to the fastening means provided at said first end of a respective one of said straps.

14. The portable seat cushion of claim 13, wherein the length of each of said straps extending between the portion of each of said straps that is sewn to said rear back panel and at least one of the fastening means provided at said first and second ends of each of said straps is adjustable.

15. The portable seat cushion of claim 13, further comprising:

a first carrying handle formed by a first carrying handle strap and a second carrying handle formed by a second carrying handle strap, each of said first carrying handle strap and said second carrying handle strap having a first end and a second end, said first carrying handle and said second carrying handle each having a length, said first and second carrying handle being attached to said rear surface of said back of the portable seat cushion.

16. The portable seat cushion of claim 15, the portable seat cushion having a seat and a back, between the seat or chair and a person sitting on the seat or chair to provide greater comfort to the person, the portable seat cushion further comprising a shoulder strap having a length, said shoulder strap extending between attachment points on the left and right sides of said back of the portable seat cushion, said shoulder strap being configured to allow over-the-shoulder carry of the portable seat cushion when the portable seat cushion is in the rolled-up configuration, said shoulder strap being configured for being placed around the back of a seat or chair and cinched around the back of the seat or chair to thereby secure the portable seat cushion to the seat or chair with said seat of the portable seat cushion being positioned over the seat of the seat or chair, and the length of said shoulder strap being adjustable.

17. The portable seat cushion of claim 15, further comprising:

a first ring provided on said portion of said second strap that is sewn to said rear back panel;

a second ring provided on said portion of said second strap that is sewn to said rear back panel at a location spaced apart from said first ring;

a first three bar strap slide provided on said first carrying handle strap at a position along said first carrying handle strap, said first three bar strap slide having two lateral bars and a middle bar; and a second three bar strap slide provided on said second carrying handle strap at a position along said second carrying handle strap, said second three bar strap slide having two lateral bars and a middle bar, wherein said first end of said first carrying handle strap and said first end of said second carrying handle strap are attached to said portion of said first strap that is sewn to said rear back panel at locations that are spaced apart, wherein a first portion of said first carrying handle strap extends between said lateral bars and said middle bar of said first strap slide such that said first carrying handle strap passes from one side of said first strap slide to the other side, passes around said middle bar of said first strap slide, and then passes back to the one side of said first strap slide, wherein said first carrying handle strap extends further in a loop through said first ring and returns to said first strap slide and passes between said middle bar of said first strap slide and said first portion of said first carrying handle strap and is then sewn back on itself to thereby form a sleeve around said middle bar of said first strap slide and fix said first strap slide to said second end of said first carrying handle strap, wherein the length of said first carrying handle can be adjusted by adjusting said position of said first strap slide along said first carrying handle strap, wherein a first portion of said second carrying handle strap extends between said lateral bars and said middle bar of said second strap slide such that said second carrying handle strap passes from one side of said second strap slide to the other side, passes around said middle bar of said second strap slide, and then passes back to the one side of said second strap slide, wherein said second carrying handle strap extends further in a loop through said second ring and returns to said second strap slide and passes between said middle bar of said second strap slide and said first portion of said second carrying handle strap and is then sewn back on itself to thereby form a sleeve around said middle bar of said second strap slide and fix said second strap slide to said second end of said second carrying handle strap, wherein the length of said second carrying handle can be adjusted by adjusting said position of said second strap slide along said second carrying handle strap.

* * * * *